US010398919B2

(12) United States Patent
Krull et al.

(10) Patent No.: US 10,398,919 B2
(45) Date of Patent: Sep. 3, 2019

(54) EXERCISE METHODS AND APPARATUS

(71) Applicants: Mark A. Krull, New Braunfels, TX (US); Stephen P. Ihli, Santa Monica, CA (US)

(72) Inventors: Mark A. Krull, New Braunfels, TX (US); Stephen P. Ihli, Santa Monica, CA (US)

( * ) Notice: Subject to any disclaimer, the term of this patent is extended or adjusted under 35 U.S.C. 154(b) by 289 days.

(21) Appl. No.: 15/477,220

(22) Filed: Apr. 3, 2017

(65) Prior Publication Data

US 2018/0021617 A1 Jan. 25, 2018

Related U.S. Application Data

(60) Provisional application No. 62/318,250, filed on Apr. 5, 2016, provisional application No. 62/319,266, filed on Apr. 6, 2016.

(51) Int. Cl.

*A63B 21/00* (2006.01)
*A63B 21/02* (2006.01)
*A63B 21/04* (2006.01)

(52) U.S. Cl.

CPC ..... *A63B 21/00069* (2013.01); *A63B 21/023* (2013.01); *A63B 21/0442* (2013.01); *A63B 21/153* (2013.01); *A63B 21/4013* (2015.10); *A63B 21/4015* (2015.10); *A63B 21/4019* (2015.10); *A63B 21/4034* (2015.10); *A63B 21/4035* (2015.10)

(58) Field of Classification Search

None

See application file for complete search history.

(56) References Cited

U.S. PATENT DOCUMENTS

| | | | | |
|---|---|---|---|---|
| 766,743 | A | 8/1904 | Terry | |
| 913,799 | A | 3/1909 | Burguet | |
| 1,390,095 | A | 9/1921 | Dettinger | 607/78 |
| 1,573,362 | A | 2/1926 | Stovall | 482/148 |
| 1,954,762 | A | 3/1932 | Wolff | 482/127 |
| 2,951,702 | A | 5/1958 | Goodwin | 482/127 |
| 2,959,414 | A | 6/1958 | Saltz | 482/127 |
| 3,610,617 | A | 10/1971 | Hepburn | 482/116 |
| 3,841,627 | A | 10/1974 | Vetter | 482/110 |
| 3,885,789 | A | 5/1975 | Deluty | 482/120 |
| 4,174,832 | A | 11/1979 | Thompson | 482/120 |
| 4,328,965 | A | 5/1982 | Hatfield | 482/122 |
| 4,625,962 | A | 12/1986 | Street | 482/116 |
| 4,779,866 | A | 10/1988 | Marshall | 482/116 |
| 4,948,119 | A | 8/1990 | Robertson | 482/56 |
| 5,195,937 | A | 3/1993 | Engel | 482/119 |
| 5,226,867 | A | 7/1993 | Beal | 482/127 |
| 5,292,293 | A | 3/1994 | Schumacher | 482/4 |
| 5,302,161 | A | 4/1994 | Loubert | 482/8 |
| 5,324,243 | A | 6/1994 | Wilkinson | 482/92 |

(Continued)

*Primary Examiner* — Joshua Lee

(57) ABSTRACT

An exercise apparatus includes a cable that is pulled from a sheave when the extraction force is sufficient to rotate a drum that is linked to the sheave. A brake material is sandwiched between the drum and at least one tension band to provide adjustable resistance to rotation of the drum. A knob is rotated to adjust tension in the at least one tension band without adversely affecting tension in the brake material. Indicia associated with rotation of the knob show changes in the resistance level as the knob rotates through more than one complete revolution.

20 Claims, 26 Drawing Sheets

(56) References Cited

U.S. PATENT DOCUMENTS

| | | | | |
|---|---|---|---|---|
| 5,358,461 | A | 10/1994 | Bailey | 482/2 |
| 5,397,285 | A | 3/1995 | Haan et al. | 482/61 |
| 5,437,591 | A | 8/1995 | Chen | 482/127 |
| 5,486,149 | A | 1/1996 | Smith | 482/120 |
| 5,509,873 | A | 4/1996 | Corn | 482/74 |
| 5,618,249 | A | 4/1997 | Marshall | 482/127 |
| 5,709,637 | A | 1/1998 | Gow | 482/129 |
| 5,733,231 | A | 3/1998 | Corn | 482/120 |
| 5,755,646 | A | 5/1998 | Chu | 482/118 |
| 5,792,034 | A | 8/1998 | Kozlovsky | 482/124 |
| 5,876,310 | A | 3/1999 | Mackey | 482/74 |
| 6,099,447 | A | 8/2000 | Ramsaroop | 482/127 |
| 6,149,559 | A | 11/2000 | Mackey | 482/124 |
| 6,283,899 | B1 | 9/2001 | Charnitski | 482/110 |
| 6,315,701 | B1 | 11/2001 | Shifferaw | 482/114 |
| 6,544,152 | B2 | 4/2003 | Rosati | 482/126 |
| D487,123 | S * | 2/2004 | Ihli | D21/662 |
| 6,726,607 | B1 | 4/2004 | Ihli | 482/127 |
| 6,770,014 | B2 | 8/2004 | Amore | 482/92 |
| 7,087,001 | B1 * | 8/2006 | Ihli | A63B 21/015 119/795 |
| 7,250,021 | B2 | 7/2007 | Leight | 482/116 |
| 7,322,909 | B1 | 1/2008 | Loccarini | 482/129 |
| 8,465,401 | B1 * | 6/2013 | Ihli | A63B 21/00185 482/116 |
| 8,523,745 | B1 * | 9/2013 | Ihli | A63B 21/00185 482/114 |
| 8,556,783 | B1 * | 10/2013 | Ihli | A63B 21/015 482/115 |
| 8,556,785 | B1 * | 10/2013 | Ihli | A63B 21/015 482/116 |
| 8,622,879 | B1 | 1/2014 | Ihli | 482/124 |
| 8,845,499 | B1 * | 9/2014 | Boatwright | A63B 21/015 482/116 |
| 8,998,779 | B1 * | 4/2015 | Ihli | A63B 21/00185 482/115 |
| 10,143,880 | B1 * | 12/2018 | Boatwright | A63B 21/153 |
| 2003/0087735 | A1 * | 5/2003 | Chen | A63B 21/025 482/116 |
| 2003/0153441 | A1 | 8/2003 | Berns | 482/128 |
| 2003/0211920 | A1 | 11/2003 | Mandel | 482/116 |
| 2004/0102292 | A1 * | 5/2004 | Pyles | A63B 21/0051 482/54 |
| 2006/0040805 | A1 | 2/2006 | Wilkinson | 482/124 |
| 2010/0137105 | A1 | 6/2010 | McLaughlin | 482/8 |
| 2015/0011368 | A1 * | 1/2015 | Manor | A63B 21/0051 482/116 |

* cited by examiner 100b
155
135

100b 112b
100b
135

137
113
137
112a
100b
157
157

100b
139
159

100b
155

112a
157
157
112b 629
621
623
629

627
626
628
623

623c
629
621
629

626
623c
626

629
621b
623b
629

626b
623b 621d
629
623d
629

637
623d
635

633
623d
635

EXERCISE METHODS AND APPARATUS

CROSS-REFERENCE TO RELATED APPLICATIONS

Disclosed herein is subject matter that is entitled to the filing dates of U.S. Provisional Application No. 62/318,250, filed Apr. 5, 2016, and U.S. Provisional Application No. 62/319,266, filed Apr. 6, 2016.

FIELD OF THE INVENTION

The present invention relates to exercise equipment, including provisions of and applications for selectively adjustable resistance to exercise using a brake drum, a brake band assembly, and a brake strip sandwiched therebetween.

BACKGROUND OF THE INVENTION

A variety of exercise devices have been developed to resist exercise motion. Examples are disclosed in U.S. Pat. Nos. 6,726,607 and 7,087,001 to Ihli, and in U.S. Pat. Nos. 8,465,410, 8,523,745, 8,556,783, 8,556,785, 8,622,879, and 8,998,779 to Ihli et al. An object of the present invention is to provide improved versions of such exercise devices and/or improved methods of using same.

SUMMARY OF THE INVENTION

One aspect of the present invention involves exercise resistance devices having a cord that is wrapped about a sheave. The cord is extracted from the sheave in response to an externally-supplied user force, and rewound onto the sheave when an internally-supplied spring force exceeds the user force. Certain features of the present invention involve a shell that contains and/or is disposed about the sheave, while others involve arrangements for routing the cord from the sheave (disposed inside the shell) to a force receiving member (disposed outside the shell), and still others involve use on equipment that does not require a shell.

In another regard, the shell is sized and configured to fit comfortably in a person's open hand. A strap is preferably secured in a closed loop about the shell to extend across the back of the person's hand when the shell is held in the palm of the person's hand. The shell is preferably provided with diametrically opposed slits through which the strap is routed. A bracket is preferably sandwiched between a right shell half and a left shell half, and the bracket may be configured to help define the slits or remain clear of the slits. The shell halves are preferably configured to define relatively deep slits that discourage twisting and/or bunching of the strap relative to the shell and/or a person's hand.

In another regard, the shell is sized and configured to be mounted comfortably on or near a person's foot. The shell is preferably provided with a third slit, which may be described as located at 6:00 relative to the diametrically opposed slits being at 3:00 and 9:00. The hand strap cooperates with a second strap to anchor the shell relative to a person's shoe.

In another regard, the shell is sized and configured to readily snap into and out of a bracket that may be a stand-alone item, part of a larger item, or mounted on an otherwise conventional type of exercise equipment, such as a treadmill, for example. Recesses on the shell align with and engage flanges on the bracket. A spring on the bracket preferably deflects to receive the shell and/or to accommodate removal of the shell from the bracket, while other structures on the bracket and the shell cooperate to maintain alignment between the two components.

In another regard, a first shell is mounted on a left end of a foot platform, and a second shell is mounted on an opposite, right end of the foot platform. More specifically, each shell is mounted on a bracket, which in turn, is pivotally mounted on a respective side of the foot platform. Each bracket pivots between an "inboard" position, placing the shell relatively closer to the middle of the foot platform, and an "outboard" position, placing the shell relatively further from the middle of the foot platform.

In another regard, an insert is sized and configuration for insertion into a tube member on the foot platform. The insert provides a resilient latch for latching the pivoting bracket in either position relative to the foot platform, reinforces a bolt interconnected between the tube member and the pivoting bracket, and caps the end of the tube member in aesthetically pleasing fashion.

In another regard, left and right handlebars are mounted on respective left and right ends of a foot platform. Each handlebar includes a lower end that extends vertically into engagement with the foot platform, a lower hand grip that extends perpendicular to the lower end, and an upper hand grip that extends perpendicular to both the lower hand grip and the lower end. The left handlebar is a mirror image of the right handlebar, and the two handlebars may be positioned in at least four alternative orientations relative to the foot platform to reposition the hand grips for accessibility and stabilization during various exercises, some of which preferably involve standing on the foot platform and using one's legs to pull cord(s) from the sheave(s).

In another regard, a "hankle" strap is secured to the external end of the cord to serve as a user engaging member and/or a force receiving member. The hankle strap is sized and configured to comfortably fit about a person's hand and alternatively about a person's ankle. A ring is secured to the hankle strap in a manner that minimizes discomfort to a user when the cord is connected to the ring via a carabiner and pulled in various directions during exercise.

In another regard, one or more guides on the shell route the cord to and from a gap defined between the walls of the sheave. As a result, the cord is prevented from riding against either wall of the sheave, which might otherwise cause a stacking effect of the cord during re-wind and/or a jumping effect of the cord during extraction. The cord guides also reduce "drag" on the cord which would otherwise negatively impact the "feel" of the resistance and/or the durability of the apparatus.

In another regard, a brake drum is operatively connected to the sheave to rotate with the sheave when cord is being extracted from the sheave, and to remain stationary when the sheave is rotating in an opposite, rewind direction. A brake strap is disposed about the perimeter of the drum, with a first end of the strap secured in place and an opposite, second end free to accommodate changes in the length of the strap. At least one brake band is looped about the brake drum with the brake strap sandwiched therebetween. Tension in the brake band(s) is adjusted to exert more or less compressive force against the brake strap and the brake drum, thereby adjusting resistance to rotation of the brake drum and the sheave. The second end of the brake strap is preferably loosely inserted into a slot in the brake drum proximate the first end of the brake strap. This arrangement contributes to smooth feeling resistance with a consistent thickness of brake strap material about the perimeter of the brake drum.

In another regard, a spring bushing is interconnected between the frame and an inner end of the spring that re-winds the sheave. An inner portion of the spring bushing defines a round perimeter disposed inside the coils of the spirally wrapped spring coils, thereby encouraging smooth and reliable spring action. An outer portion of the spring bushing is accessible for connection and/or rotational adjustment relative to a proximate frame member.

In another regard, a first sheave and brake drum combination are mounted on a foot end of a frame, and a second sheave and brake drum combination are mounted on an opposite, head end of the frame, and a body support is mounted on the frame therebetween to support a person in a supine position between the foot end and the head end. The aforementioned hankle strap or another suitable force receiving member is interconnected linearly between the two resistance assemblies, and the person pulls the force receiving member away from one assembly subject to positive resistance from that assembly, and then pushes the force receiving member away from the other assembly subject to positive resistance from the other assembly.

In another regard, the sheave and the brake drum are rotatably mounted on a frame and connected to a force receiving member, such as a body supporting carriage rollably mounted on the frame. A second sheave is similarly connected to the brake drum and operatively connected in a "reverse direction" to the carriage, so one sheave drives the brake drum when the carriage moves in a first direction, and the other sheave drives the brake drum when the carriage moves in an opposite, second direction.

In another regard, the frame may include a pivoting foot platform that pivots in real time between a first orientation to accommodate a leg press exercise that drives the carriage in the first direction, and a second orientation to accommodate a leg curl exercise that drives the carriage in the second direction.

In another regard, a cord is secured between the ends of the frame to extend directly therebetween. A handle is secured in place on an intermediate portion of the cord, so a person supported on the carriage can push in a first direction on the handle to move the carriage in a first direction, and pull in an opposite, second direction on the handle to move the carriage in an opposite, second direction.

In another regard, display of the current resistance setting and/or adjustments to the resistance setting may be controlled electronically. With reference to the aforementioned shell, for example, a display screen may be incorporated into the shell, provisions may be made to calibrate the resistance, and/or sensors may be used to track manual adjustments to the resistance setting. With reference to the aforementioned rolling carriage embodiment, for example, automated adjustment may be implemented using a stepper motor, a linear actuator, or other known automation device. In addition, relevant data may be sent and/or received using a cellular phone.

The foregoing features of the present invention may be practiced individually and/or in various combination with one another and/or with other features that will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
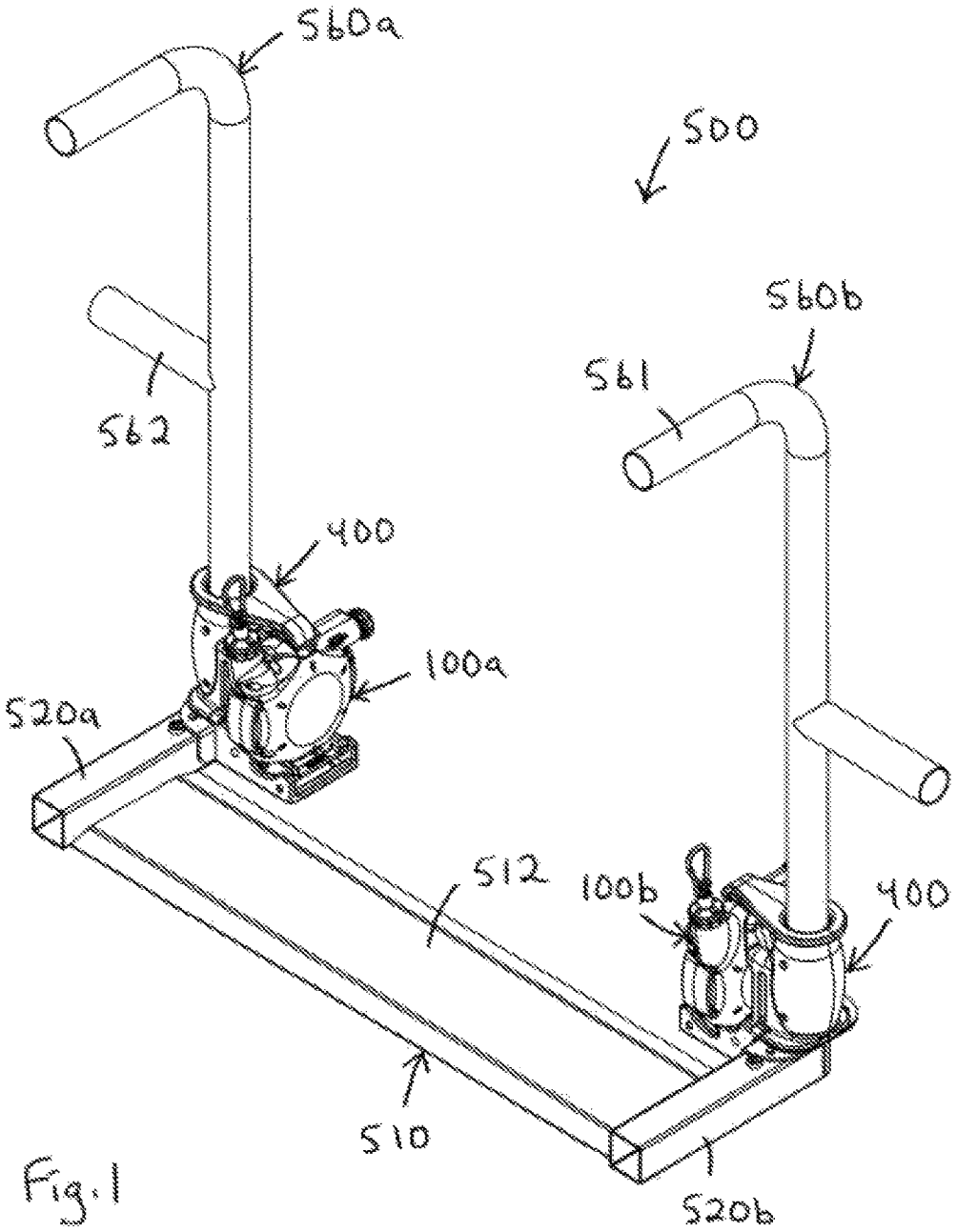
FIG. 1 is a perspective view of an exercise apparatus constructed according to the principles of the present invention.

In some respects, the present invention may be described in terms of improvements suitable for use separately and/or in connection with exercise equipment already known in the art. In other respects, the present invention may be described in terms of improvements to the exercise apparatus disclosed in U.S. Pat. Nos. 6,726,607 and 7,087,001 to Ihli, and in U.S. Pat. Nos. 8,465,410, 8,523,745, 8,556,783, 8,556,785, 8,622,879, and 8,998,779 to Ihli et al., all of which are incorporated herein by reference to supplement this disclosure regarding the construction, features, and/or use of the present invention. With regard to the latter, this description may focus more on distinctions between these prior art devices and the present invention, given the fact that shared attributes are already disclosed in the above-referenced patents.

FIGS. 1 and 5*a*-5*d* show an exercise apparatus, system, and assembly 500 constructed according to the principles of the present invention. Generally speaking, the apparatus 500 includes a base 510; left and right handlebars 560*a* and 560*b* selectively connected to the base 510; and left and right resistance modules 100*a* and 100*b* selectively connected to the base 510. The handlebars 560*a* and 560*b* are mirror images of one another, and the resistance modules 100*a* and 100*b* are mirror images of one another.

The base 510 may be described in terms of a rigid, low-profile foot platform 512 shaped like a doorway threshold. In this regard, the platform 512 has an angled front edge, an angled rear edge, and a flat main section that extends parallel to an underlying floor surface and within one inch of the floor surface. Identical left and right tubes 520*a* and 520*b* are secured to the left and right ends of the foot platform 512, preferably by welding. For reasons discussed below, three separate holes extend through the top wall of each tube 520*a* and 520*b* proximate the front end. Plugs (not shown) are preferably inserted into the rear ends of the tubes 520*a* and 520*b*. Relatively more complicated plugs or inserts 530 (shown in FIGS. 2 and 4) are inserted into the front ends of the tubes 520*a* and 520*b*.

Figure 2:
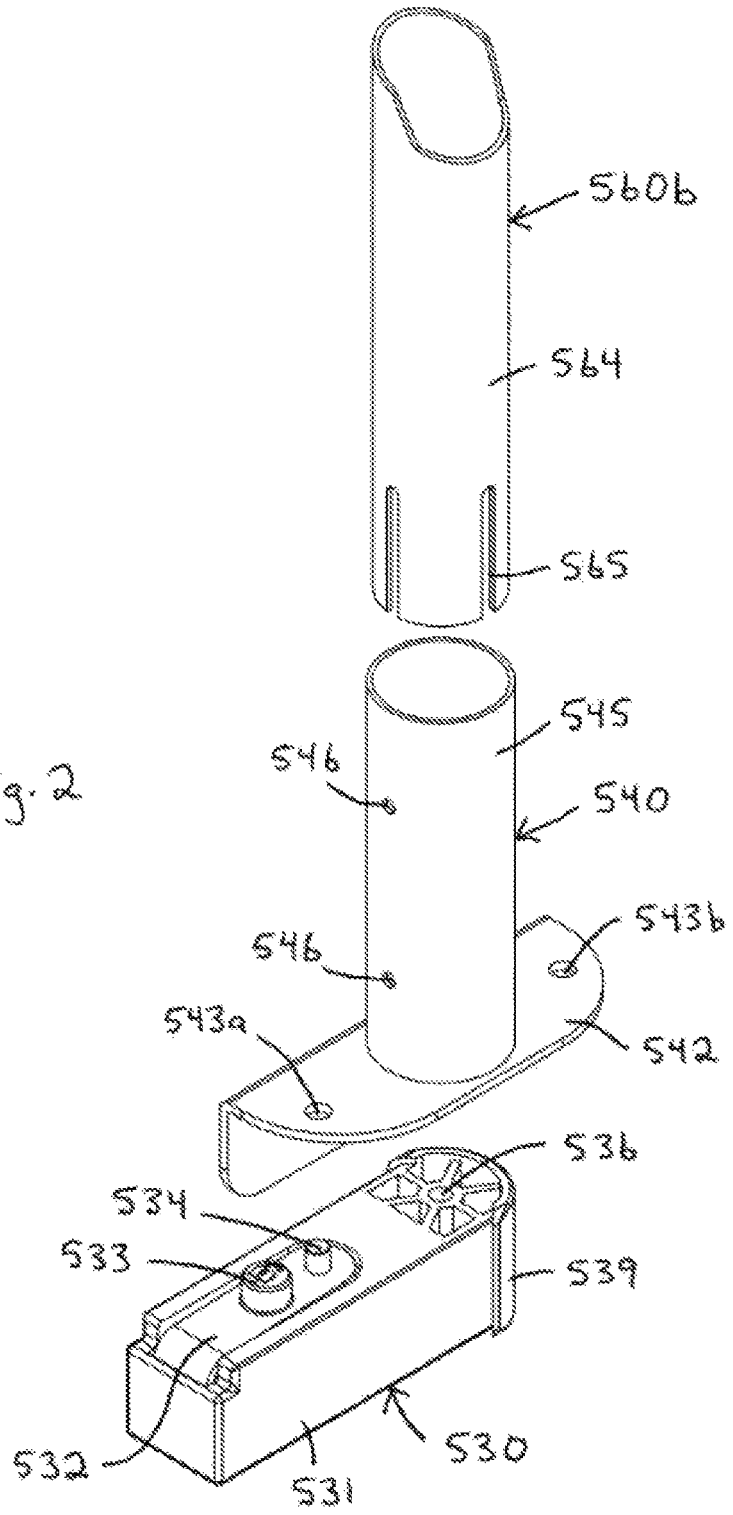
FIG. 2 is an exploded perspective view of certain components of the exercise apparatus shown in FIG. 1.

With reference to FIG. 2, each plug 530 is preferably injection molded plastic, and includes a main body or base 531 that is sized and configured to fit snugly inside a respective tube 520*a* or 520*b*. A leaf spring 532 is integrated into a rearward end of the base 531 to extend forward directly beneath an upper wall of the tube 520*a* or 520*b*. A button 533 projects upward from an intermediate portion of the leaf spring 532, and a relatively more durable pin 534 extends upward from a distal forward end of the leaf spring 532. A reinforced bolt hole 536 extends vertically through a forward end of the base 531, and a lower end of the hole 536 terminates in a hex-shaped opening sized and configured to house a hex-shaped nut (not shown). The forward end of the base 531 terminates in a semi-cylindrical outer surface 539 sized and configured to "cap" the exposed edges of a respective tube 520*a* or 520*b*.

FIG. 2 also shows a rigid support bracket 540 having a cylindrical tube or support 545 welded on top of an angle iron member 542. An axis extends longitudinally through the center of the tube 545, and two bolt holes 546 extend radially though the tube 545 and intersect the axis. The member 542 has a vertical sidewall and a horizontal sidewall, and the latter extends perpendicular to the axis defined by the tube 545. Equidistant from the axis, holes 543*a* and 543*b* extend through the horizontal sidewall of the member 542. A middle hole (not shown) extends through the horizontal sidewall in alignment with the axis.

Figure 3B:
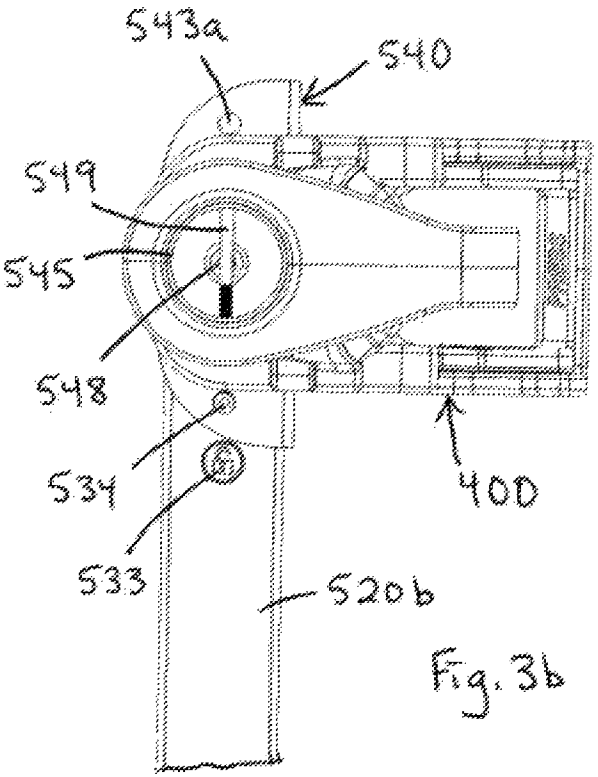
FIGS. 3*a*-3*b* are top views of certain components of the exercise apparatus of FIG. 1 arranged in two different configurations.
Figure 3A:
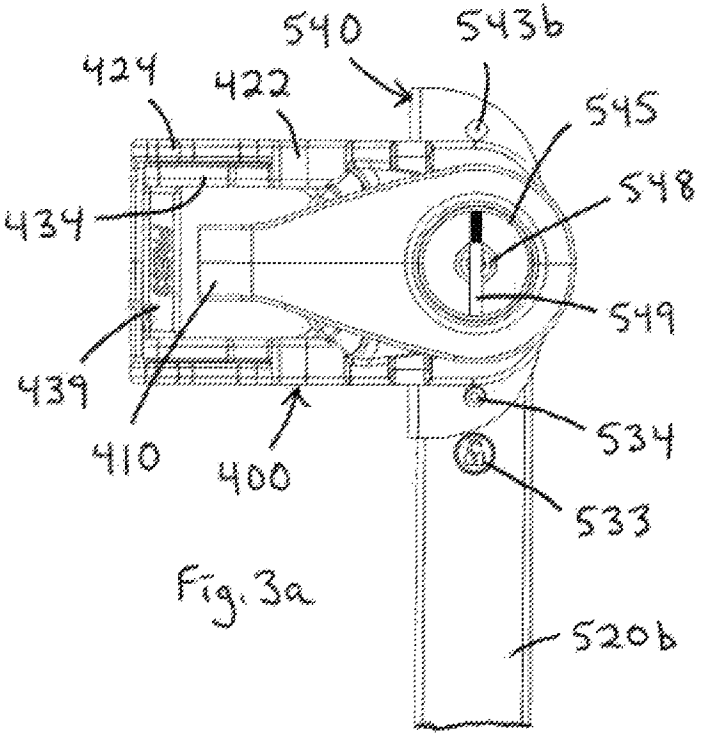

FIGS. 3*a*-3*b* show the bracket 540 rotatably connected to the tube 520*b* and the insert 530 by means of a bolt 548 threaded into the hex-shaped nut described above (but not shown). The bolt 548 extends through the middle hole in the member 542, through the forwardmost of the three holes in the top wall of the tube 520*b*, and through essentially all of the insert 530. Different exercises can be better accommodated by rotating the brackets 540 into different orientations relative to the foot platform 512. Regardless of how the bracket 540 is oriented relative to the tube 520*b*, the horizontal sidewall of the member 542 bears against the top wall of the tube 520*b* to help stabilize the bracket 540 relative to the tube 520.

FIG. 3*a* shows the bracket 540 rotated to a first extreme orientation with the vertical sidewall of the member 542 bearing against the inside wall of the tube 520*b* (which further helps stabilize the bracket 540 relative to the tube 520*b*). In this configuration, the button 533 projects upward through the rearwardmost of the three holes in the top wall of the tube 520*b*, and the pin 534 projects upward through both the intermediate hole in the top wall of the tube 520*b* and the hole 543*a* in the member 542. In other words, the insert 530 functions along the lines of a snap button to latch the bracket 540 in the depicted orientation relative to the tube 520*b*. Pushing downward on the button 533 moves the pin downward 534 out of the hole 543*a* to release the bracket 540 for rotation out of this orientation. FIG. 3*b* shows the bracket 540 rotated to an opposite, second extreme orientation with the vertical sidewall of the member 542 bearing against the outside wall of the tube 520*b* (which again, further helps stabilize the bracket 540 relative to the tube 520*b*). In this orientation, the pin 534 projects upward through both the intermediate hole in the top wall of the tube 520*b* and the hole 543*b* in the member 542.

To receive and support the resistance modules 100*a* and 100*b*, identical left and right clip brackets 400 are rigidly mounted on respective support brackets 540. As shown in FIGS. 3*a*-3*b*, each clip bracket 400 "sleeves" onto and/or "sandwiches" a respective tube 545 and is secured in place by upper and lower bolts 549. The bolts 549 extend through the holes 546 in the tube 545 and aligned holes in the sides of the bracket 400, and are threaded into mating nuts (visible in FIGS. 9*a*-9*b* and 10*a*-10*b*). The clip brackets 400 are discussed in greater detail (together with the resistance modules 100*a* and 100*b*) further along in this description.

Each handlebar 560*a* and 560*b* preferably includes a relatively longer first cylindrical tube having a ninety degree bend proximate its upper end, and a relatively shorter second cylindrical tube welded to an intermediate portion of the first tube. As shown in FIG. 2, the lower end 564 of the first tube is sized and configured for snug insertion into the tube 545 on a respective support bracket 540. First and second pairs of diametrically opposed slits 565 extend through the lower end 564 to provide clearance for at least the upper of the two bolts 549 extending through the tube 545 (see FIGS. 3*a*-3*b*). As shown in FIGS. 5*a*-5*d*, the bolt(s) 549 cooperate with alternative pairs of slits 565 to receive either handlebar 560*a* or 560*b* in any of four orientations.

Figure 5A:
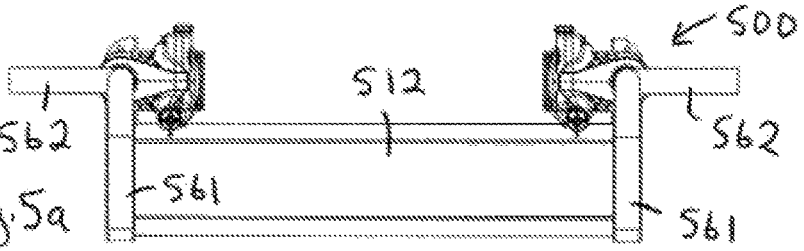
FIGS. 5*a*-5*d* are top views of the exercise apparatus of FIG. 1 with the handlebar components arranged in four different configurations.
Figure 5B:
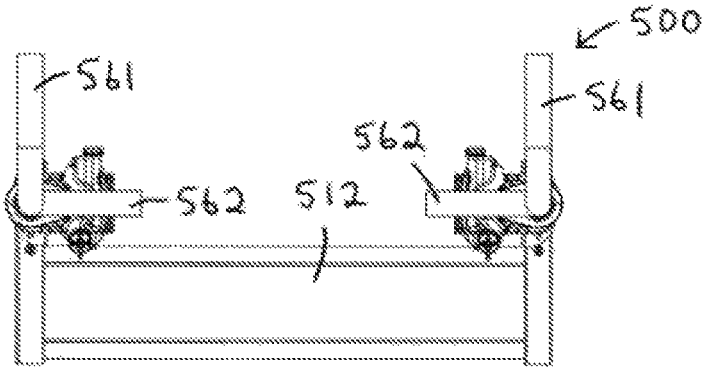
Figure 5C:
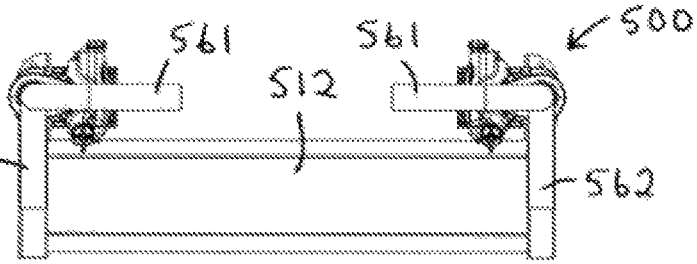
Figure 5D:
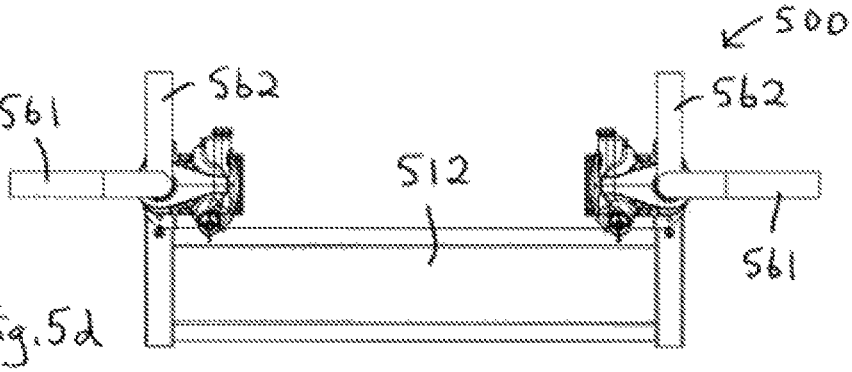

The opposite, upper end of the first tube defines a first hand grip 561 that extends in a first direction parallel to an underlying floor surface. The second tube defines a second hand grip 562 that extends in a second direction parallel to the floor surface and perpendicular to the first hand grip 561. The hand grips 561 and 562 are sized and configured for grasping in a person's hand and may be coated or covered with a "grip friendly" material. As shown in FIGS. 5*a*-5*d*, without reorienting the support brackets 540, the handlebars 560 can assume four alternative orientations relative to the foot platform 512 to reposition the hand grips 561 and 562 for accessibility, clearance, and/or stabilization during various exercises, some of which preferably involve standing on the foot platform 512 and using one's legs to pull cord(s) from the resistance module(s) 100*a* and/or 100*b*. The handlebars 560 can also be used to facilitate certain exercises when in certain positions (e.g. see how the configuration shown herein in FIG. 5*a* provides added stability for the use disclosed in FIG. 2 and associated text in the above-referenced U.S. Pat. No. 8,465,401). The handlebars 560 can also be removed from the base 510 to accommodate various other exercises (e.g. see FIG. 1 and associated text in the above-referenced U.S. Pat. No. 8,556,785).

FIGS. 6 and 7*a*-7*f* show one resistance module 100*b* from various perspectives. In one application or mode of operation, the resistance modules 100*a* and 100*b* are mounted on the apparatus 500 as shown in FIG. 1. In another application or mode of operation, at least one of the resistance modules 100*a* and 100*b* is held in the palm of a person's hand (e.g. see FIG. 7 and associated text in above-referenced of U.S. Pat. No. 8,523,745). The module 100*b* is preferably the right-side unit on the apparatus 500 (so the resistance indicator is more readily visible), but it is preferably held in a person's left hand when performing exercises with just the unit 100*b* (because it is more ideally suited for the person's left hand, and the unit 100*a* is more ideally suited for the person's right hand). However, if manufacturing efficiencies dictate that only a single unit 100*a* or 100*b* be manufactured, either unit 100*a* or 100*b* will fit relatively comfortably in either hand (and function in both brackets 400).

Each unit or module 100*a* and 100*b* preferably includes a shell or frame 110 comprising an injection molded front side housing or shell half 120, an injection molded rear side housing or shell half 140, and a stamped steel bracket 160 (see FIGS. 11, 14, and 16) sandwiched between the housings 120 and 140. In this regard, five threaded inserts are secured in respective receptacles in the rear housing 140, and five screws are inserted through holes in the front housing 120, and past edges of the bracket 160 or through holes in the bracket 160, and threaded into the inserts. Two relatively small holes extend through the bracket 160 and align with relatively small holes in the rear housing 140 to receive relatively small screws for purposes of internally securing the bracket 160 to just the rear housing 140.

Figures 7A, 7B, 7C, 7D, 7E, 7F:
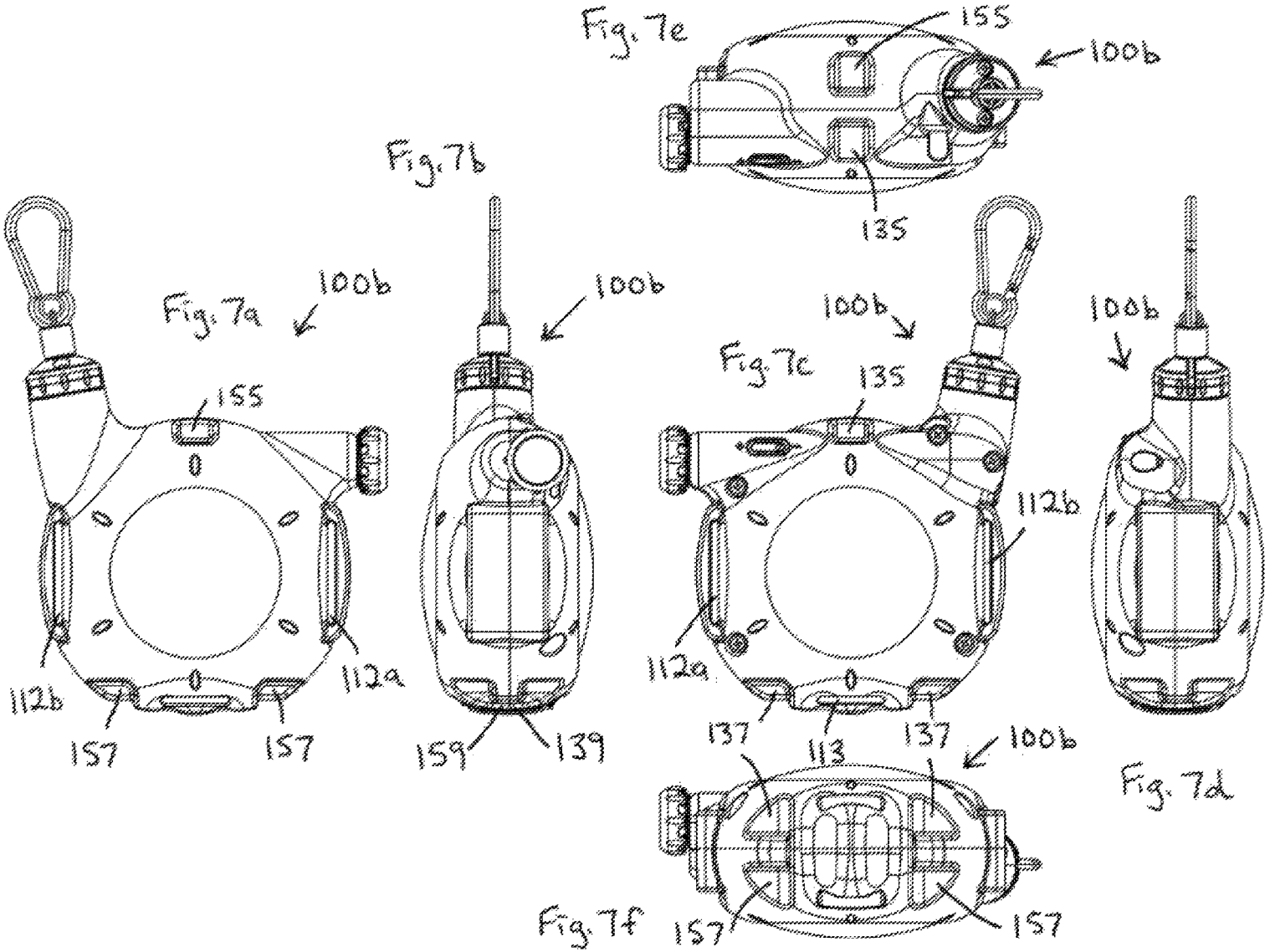
FIGS. 7*a*-7*f* are six orthogonal views of the resistance module of FIG. 6.

As shown in FIGS. 7*a* and 7*c*, along opposite edges of the shell 110, at 3:00 and 9:00 so to speak, the shell 110 defines slots 112*a* and 112*b* to receive a unit strap 960 (discussed below). The slots 112*a* and 112*b* are preferably one inch "deep" (front to back) to increase the effectiveness of the strap 960 from a stabilizing perspective. The shell 110 also defines a third slot 113 at the 6:00 position to receive a foot strap 970 (discussed below), which cooperates with the unit strap 960 to secured the unit 100*b* to a person's foot or shoe. The steel bracket 160 may be configured to reinforce the slots 112 or simply terminate short of the slots 112, depending on design and manufacturing preferences.

Figures 24, 45:
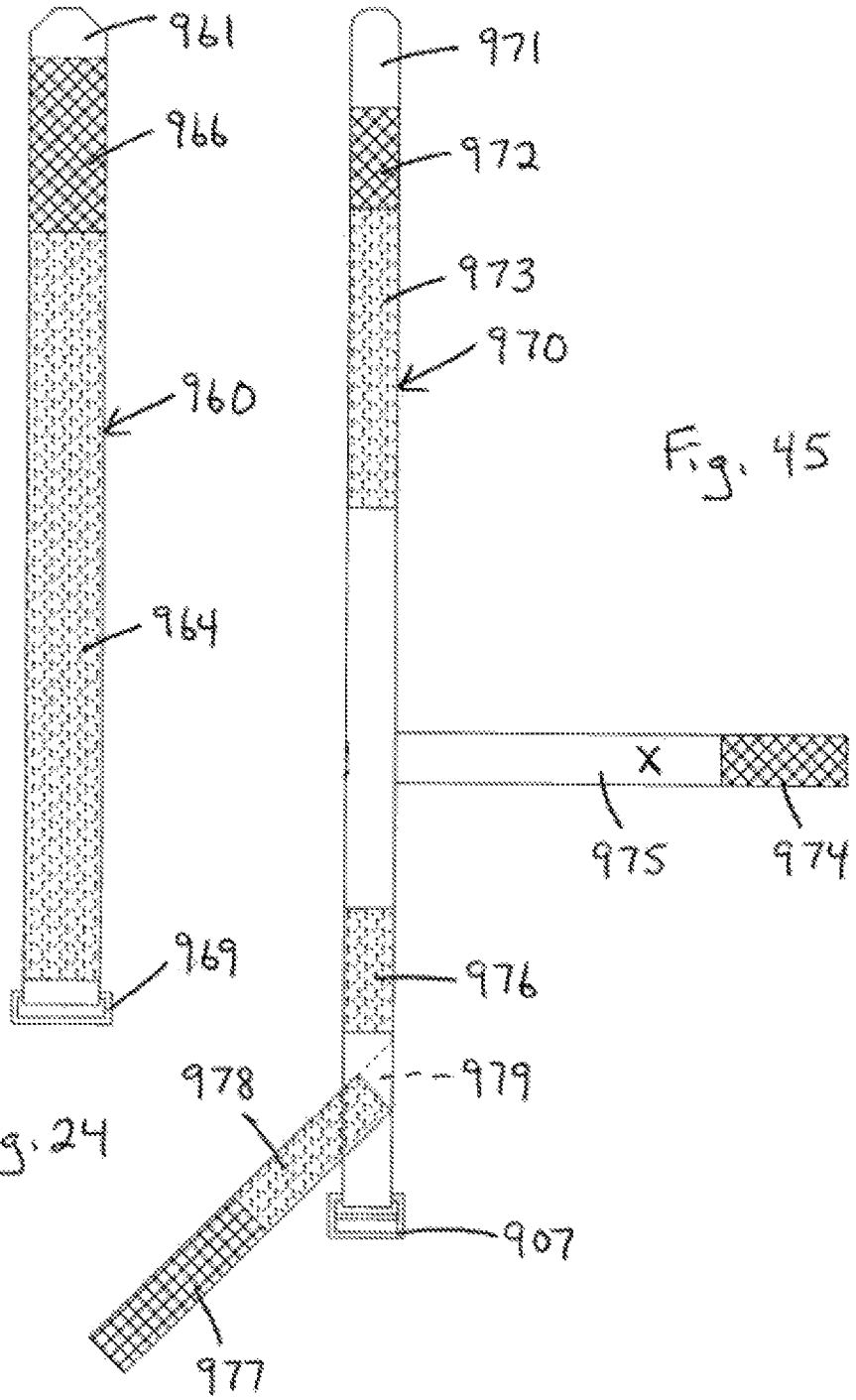
FIG. 24 (shares a drawing sheet with FIG. 45 and) is a front view of a unit strap suitable for use on the exercise apparatus of FIG. 6.
FIG. 45 is a bottom view of a foot strap that is selectively connected to the exercise apparatus of FIG. 6 and the unit strap of FIG. 24 for purposes of mounting the exercise apparatus on a person's shoe.

FIG. 24 shows a preferred embodiment unit strap 960 constructed according to the principles of the present invention. The strap 960 is preferably a nylon webbing or strap having a thickness (measured between the depicted side and the opposite side), a width of one and one-half inches (measured from the left to right in FIG. 24), and a length of twenty inches (measured from top to bottom in FIG. 24). A first end 961 of the strap 960 is tapered, and a conventional single loop buckle 969 is secured to the opposite, second end of the strap 960. A patch 964 of loop type fasteners is secured to the front side of the strap 960 just beyond the folded over material that retains the buckle 969 in place. A patch 966 of hook-type fasteners is secured to the front side of the strap 960 adjacent to the patch 964. The patch 963 is three and one-half inches long, and the patch 964 is fifteen inches long.

With the patches 964 and 966 facing away from the unit 100*b*, the tapered end 961 of the strap 960 is inserted through the slot 112*b*, and the remainder of the strap 961 is pulled through until the buckle 969 encounters the shell 110. After the strap 960 is subsequently wrapped around the rear half 140 of the shell 110, the tapered end 961 is inserted through the other slot 112*b* in the opposite direction, and the remaining available strap 961 is pulled through. After the strap 960 is subsequently wrapped around the front half 120 of the shell 110, the tapered end 961 is inserted through the buckle 969, and the remaining available strap 961 is pulled through.

A person places his hand between the rear half 140 of the shell 110 and the overlying section of the strap 960, and then after any adjustments are made for a snug fit about his hand, the patch 966 is doubled back against the patch 964 to secure the strap 960 in place.

FIG. 45 shows a preferred embodiment foot strap 970 constructed according to the principles of the present invention. The strap 970 is preferably made of nylon webbing or straps having a width of one inch. A first, main strap extends from a first end 971 that is tapered, to a second end that is secured about a conventional double loop buckle 907. A 2-inch-long patch 972 of hook-type fasteners is secured to the main strap approximately 2 inches from the first end 971. A 6-inch-long patch 973 of loop-type fasteners is secured to the main strap adjacent to the patch 972. A 3.5-inch-long patch 976 of loop-type fasteners is secured to the main strap approximately 3.5 inches from the buckle 907. Between the buckle 907 and the patch 976, a tether strap 979 is secured at an angle of 45 degrees to the main strap. A 4-inch-long patch 977 of hook-type fasteners is secured to the distal end of the tether strap 979, and a 4-inch-long patch 978 of loop-type fasteners is secured adjacent to the patch 977 (except to the extent that the patch 978 and the tether strap 979 are disposed on opposite sides of the main strap). Approximately 1.5 inches from the patch 976, a heel strap 975 is secured perpendicular to the main strap. A 2.5-inch-long patch 974 of hook-type fasteners is secured to the distal end of the heel strap 975.

FIG. 45 shows the foot strap 970 upside down relative to how it is used. During set-up, the "X" on the heel strap 975 is placed face down on the ground directly beneath the heel of a person's conventional shoe 70, as shown in 46. Because the foot strap 970 has been flipped over from FIG. 45 to FIG. 46, the tapered end 971 now extends down instead of up (from the perspective of the reader).

Figure 46:
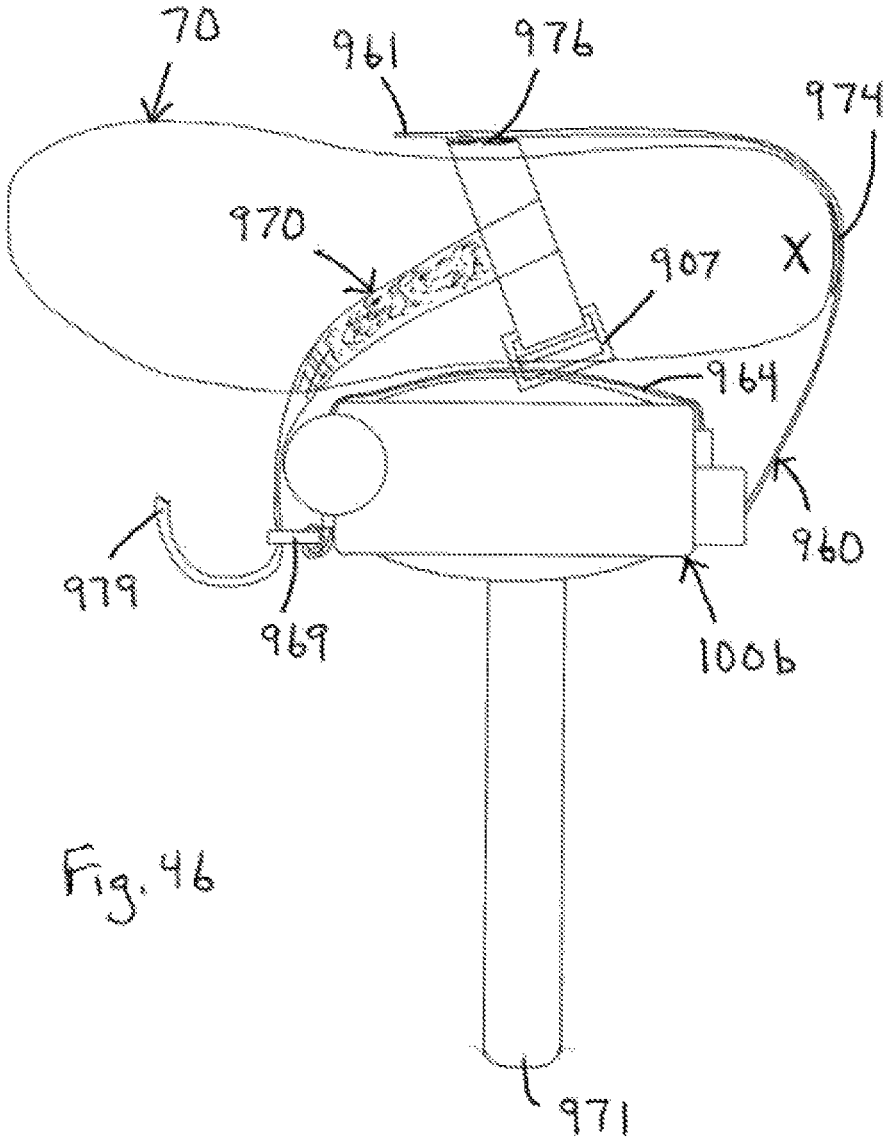
FIG. 46 is a not-to-scale, opposite, top view of the foot strap of FIG. 45 in an intermediate state of securing the exercise apparatus of FIG. 6 to a person's shoe.

In FIG. 46, the tapered end 971 has been inserted through the slot 113 in the shell 110. Also, the unit strap 960 has been partially undone and now extends from the slot 112*a* about the heel of the shoe 70 and then about the instep of the shoe 70. The heel strap 975 extends up behind the heel of the shoe 70, and the patch 974 of hook-type fasteners faces outward and engages the inwardly facing patch 946 of loop-type fasteners on the unit strap 960. Similarly, the buckle end of the foot strap 970 extends up beside the instep of the shoe 70, and the patch 976 of loop-type fasteners faces outward and engages the inwardly facing patch 966 of hook-type fasteners on the unit strap 960. The tether strap 979 is inserted through the buckle 969 on the unit strap 960 and then folds back against itself with the patch 977 engaging the adjacent patch 978. The tapered end 971 is inserted through the buckle 907 and then folds back against itself with the patch 972 engaging the adjacent patch 973. In this regard, the main strap of the foot strap 970 forms a closed loop about the unit 100*b* and the shoe 70.

The set-up may be performed with or without the shoe 70 on the person's foot. In either case, after the set-up is complete and the person's foot is in the shoe, the straps may be adjusted to ensure a comfortable and reliable fit. Then the process may be repeated for the companion shoe (and foot), if desired. With one or more units 100*a* and 100*b* strapped to his feet, a person can pull on the cables with his hands to perform various exercises while standing, sitting, on hands and knees, lying on the ground, etc.

As shown in various Figures, other features associated with the exterior of the shell 110 are sized and configured to alternatively releasably snap the unit 100*b* into and out of either clip bracket 400 (while facing either direction relative thereto). Each bracket 400 preferably includes three injection molded plastic parts. In this regard, a catch or latch 430 is secured between first and second bracket "halves" which are mirror images of one another. The backs or spines of the two halves cooperate to define a somewhat bulbous hand grip 402 sized and configured to fit in a person's half-closed hand when performing certain exercises (e.g. see FIGS. 1-2 and associated text in above-referenced U.S. Pat. No. 8,523,745). In addition to securing the clip bracket 400 to the tube 545, the bolts 549 secure the two halves together, along with two additional bolts 594 (shown in FIG. 4).

A forwardly opening notch 405 is defined by the bracket 400, and the notch 405 opens in a direction away from the hand grip 402. A slot 406 extends through the mid-section of the bracket 400, rearward of the notch 405 and forward of the handgrip 402. The slot 406 and the notch 405 are sized and configured to alternatively accommodate different arrangements of the unit strap 960 when the unit 100*b* is mounted on the bracket 400. The notch 405 simply accommodates the strap 960 as arranged on the unit for hand-held use, while the slot 406 allows the strap 960 to be partially undone from the unit 100*b* and then inserted through the slot 406 and reconnected to itself, thereby strapping the unit 100*b* to the bracket 400.

An upper forward end of the bracket 400 may be described as an upper receptacle or hook 410, including a rearward flange or block 412, a forward flange or block 414, and a downwardly opening gap 416 defined therebetween. As shown in FIGS. 7*a*, 7*c*, and 7*e*, the housing halves 120 and 140 define notches 135 and 155, respectively, which align with one another and are separated by a tab or block 116 (see FIG. 8). The flanges 412 and 414 are sized and configured for insertion into the notches 135 or 155 (in either order), and the gap 416 is sized and configured to receive the tab 116. The rearward flange 412 has an angled front edge to accommodate insertion of the tab 116 when the upper end of the unit 100*b* is tilted to an insertion orientation relative to the bracket 400 (see FIGS. 9*a*-9*b*).

A lower forward end of the bracket 400 may be described as a receptacle or base. The lowermost bolt 594 extends through an opening in a rearward portion of the catch 430 to rigidly anchor a rearward portion of the catch 430 between the two halves. The catch 430 includes left and right rails 434 that extend forward from the anchored rearward portion and define a gap therebetween, and a forwardmost "PRESS" member 439 (see FIGS. 3*a*-3*b*) that extends between lower forward ends of the two rails 434. The catch 430 is made of resilient plastic, and the rails 434 are configured to function as leaf springs.

Figure 4:
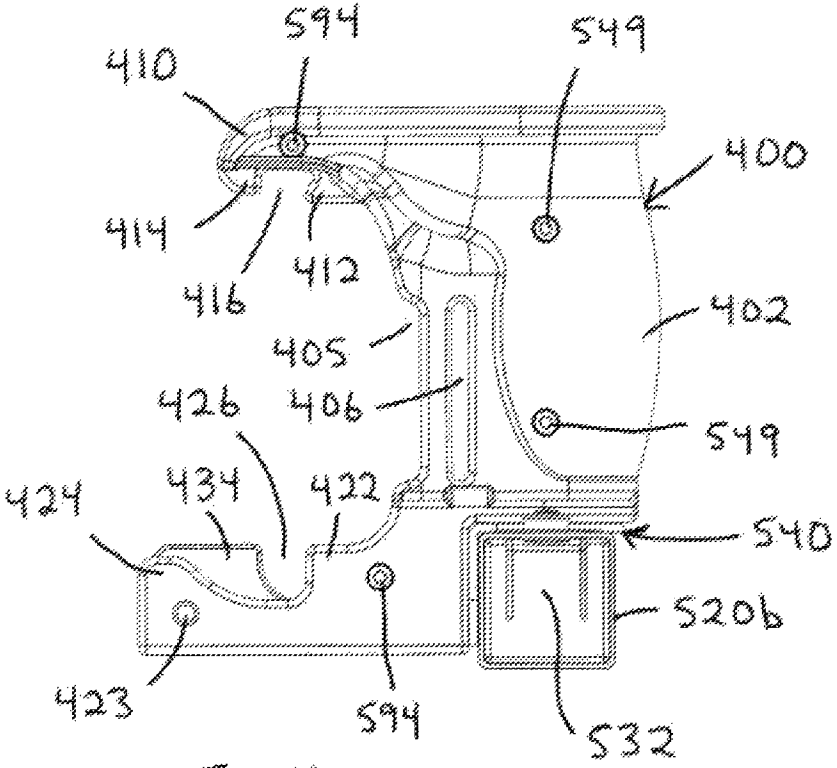
FIG. 4 is a rear end view of the configuration shown in FIG. 3*a;*

The base of the bracket 400 includes left and right walls that define an opening therebetween to accommodate the catch 430. As shown in FIGS. 3*a*-3*b* and 4, each wall includes a rearward end 422 and a relatively thinner, forward end 424. The outwardly facing sides of the walls 422 and 424 are flat and co-planar, and the inwardly facing sides of the walls 422 and 424 are flat but staggered in such a manner that the rearward ends 422 are flush with the inward facing sides of the rails 434. Also, the rearward ends of the rails 434 cooperate with the forward edges of the wall ends 422 to define respective gaps 426 therebetween (see FIG. 4), which align front to back with the gap 416 defined by the hook 410.

As shown in FIGS. 7*a*, 7*c*, and 7*f*, the housing halves 120 and 140 define pairs of notches 137 and 157, respectively, which align with one another and are separated by respective tabs (similar to the tab 116 described above). In addition, these lower tabs may be described as "clipped" to expose respective sidewalls 139 and 159 (see FIG. 7*b*) that face away from one another. These sidewalls 139 and 159 are configured and arranged for insertion between the rails 434 (and thereafter between the rearward wall ends 422) after the tab 116 between the notches 135 and 155 is inserted into the hook 410. A first line segment extends perpendicularly between (a) the sidewalls 139 and 159 under one slot 112*a* and (b) the sidewalls 139 and 159 under the other slot 112*b*, and measures approximately two inches in length. A second line segment extends vertically between (a) the midpoint of the first line segment and (b) one of the notches 135 and 155, and measures approximately four inches in length.

Figure 9A:
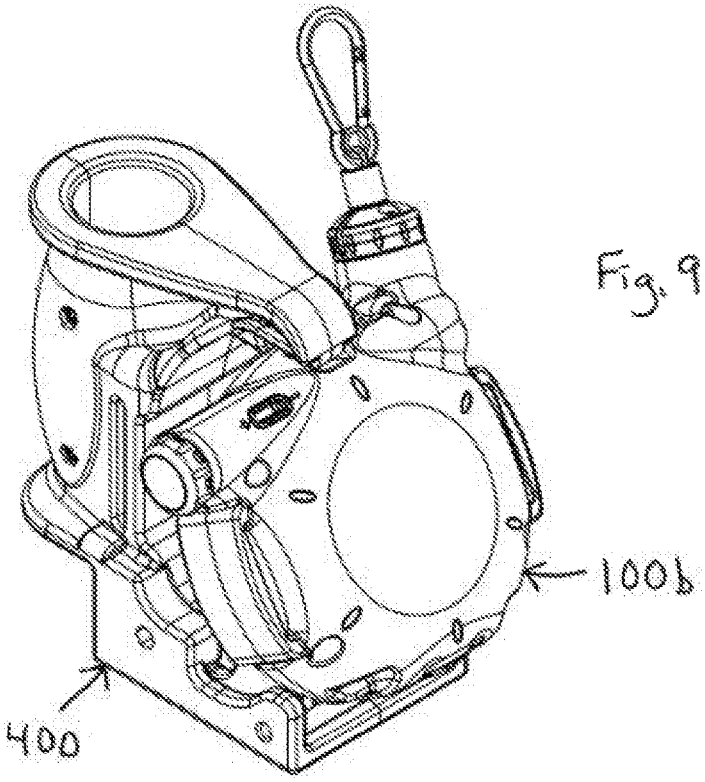
FIGS. 9*a*-9*b* are perspective and side views of the resistance module of FIG. 6 partially inserted into a clip bracket shown in FIG. 4.
Figure 9B:
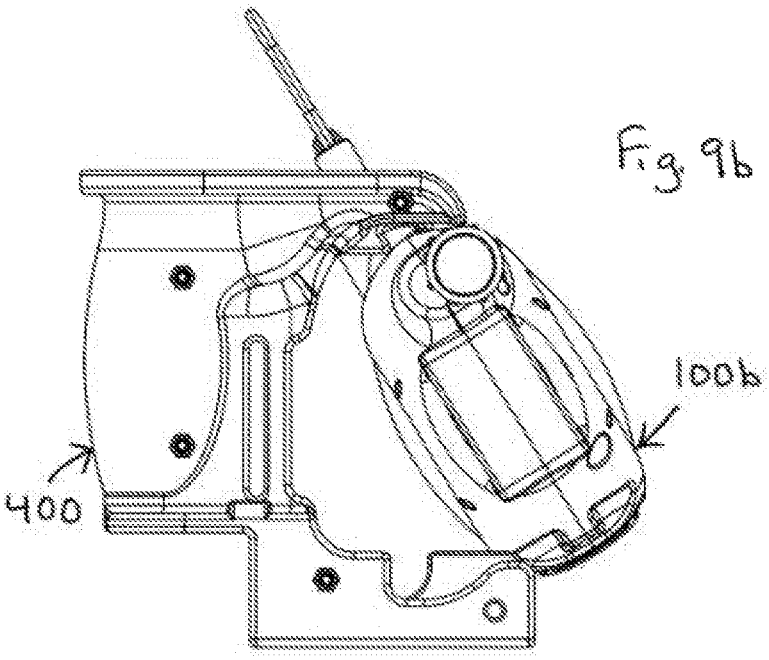
Figure 10A:
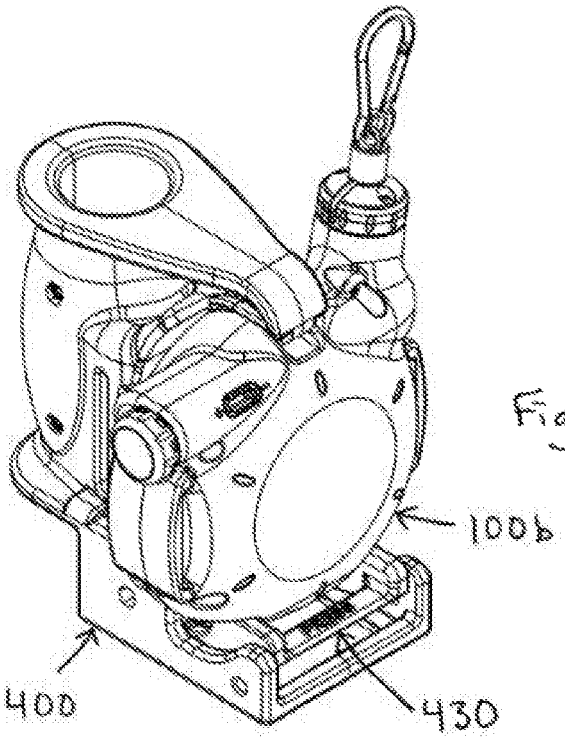
FIGS. 10*a*-10*b* are perspective and side views of the resistance module and clip bracket of FIGS. 9*a*-9*b*, with the module fully inserted into the bracket.
Figure 10B:
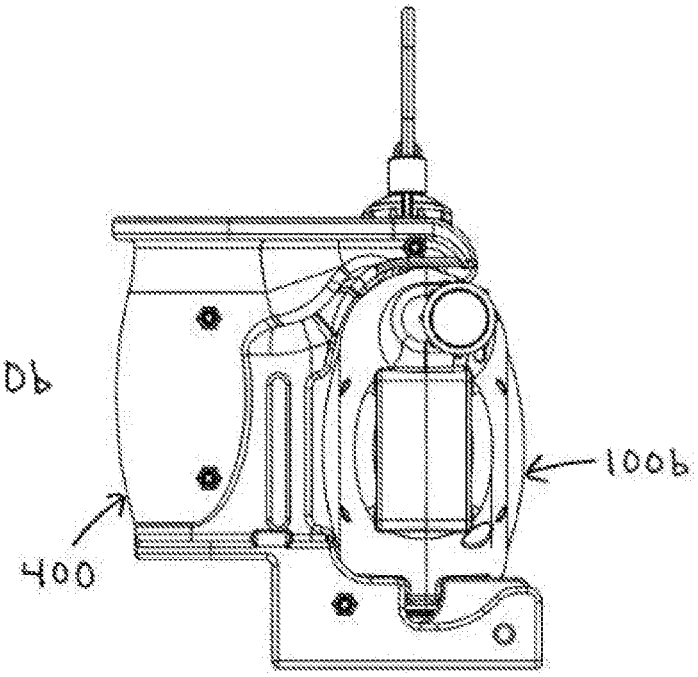

Starting from the position shown in FIGS. 9*a*-9*b*, when the lower end of the unit 100*b* is pushed further toward the lower end of the bracket 400, the rails 434 resiliently deflect downward. The rearward wall ends 422 and the rearward edges of the rails 434 are sized and configured for insertion into the notches 137 or 157 (in either order), and the gaps 426 therebetween are sized and configured to receive the tabs. As shown in FIGS. 10-10*b*, when the unit 100*b* assumes an upright orientation relative to the bracket 400, the rails 434 resiliently deflect upward to occupy respective notches 137 or 157, thereby resisting removal of the unit 100*b* from the bracket 400. The rearward wall ends 422 resist rearward and lateral movement of the unit 100*b*; the forward wall ends 424 reinforce the rails 434 against lateral movement; and the rearward facing edges of the rails 434 resist forward movement of the unit 100*b*. To remove the unit 100*b* from the bracket 400, the forward "PRESS" member 439 is pressed downward, and the lower end of the unit 100 is pulled away from the rearward wall ends 422, bringing the unit 100*b* back through the orientation shown in FIGS. 9*a*-9*b*.

FIG. 4 shows an optional hole 423 extending through the forward wall ends 424 and just beneath the rails 434 of the latch 430 to accommodate a conventional fastener, such as a spring detent pin (not shown), if desired. As an additional safety feature, insertion of this optional fastener blocks downward deflection of the catch 430, and removal of the fastener is required to release the catch 430 for downward deflection.

Among other things, persons skilled in the art will recognize that the brackets 400 may be mounted on various items other than the foot platform 512, including, for example, a bench, a bed, a post, a wall, a framework, or various known types of exercise equipment, and/or one or more of the units 100*a* and 100*b* may be supported in various other ways on any or all such items.

Figure 17:
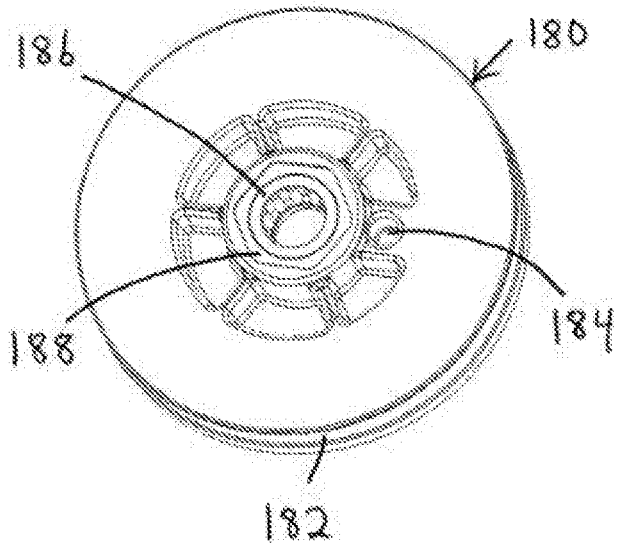
FIG. 17 is an approximately reverse perspective view of some of the components of FIG. 16.

With reference back to the resistance unit 100*b*, a flexible cord 102 extends through a re-directional bearing 200 rotatably mounted between the two halves 120 and 140 of the shell 110). As further explained below, an inner end of the cord 102 is secured to a sheave 180 (see FIGS. 11 and 17) rotatably mounted inside the housing 110, and an intermediate portion of the cord 102 is wrapped in loops inside a groove 182 defined by the sheave 180. A carabiner 88 is secured to an opposite, outer end of the cord 102 by means of at least one knot (hidden beneath a cap). The carabiner 88 is selectively connected to a force receiving member (e.g. see FIG. 6b and associated text in the above-referenced U.S. Pat. No. 8,523,745).

Figure 21:
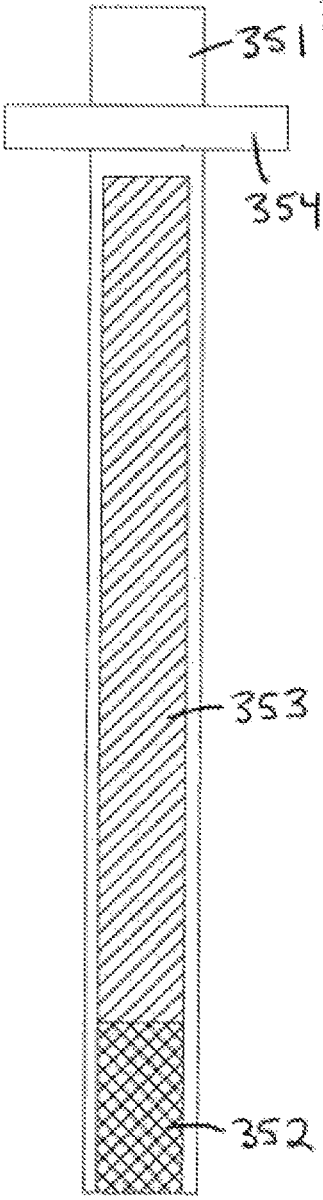
FIG. 21 is a rear view of the force receiving member of FIG. 20 in an intermediate state of manufacture.
Figure 20:
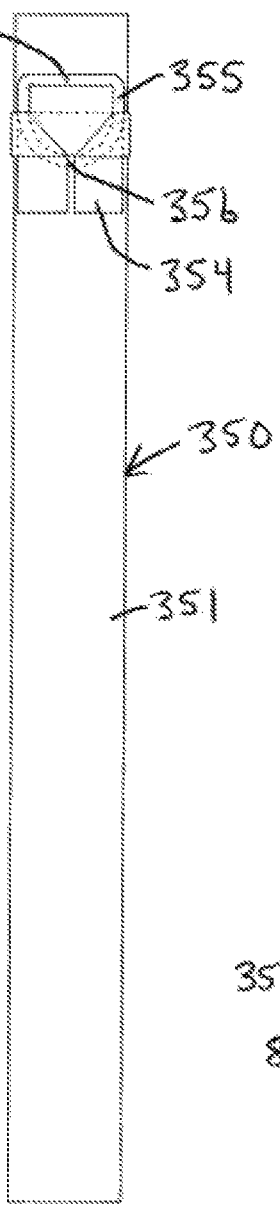
FIG. 20 is a front view of a force receiving member constructed according to the principles of the present invention and suitable for use with the exercise apparatus of FIG. 6.
Figure 22:
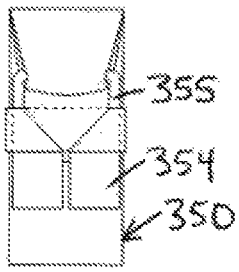
FIG. 22 is a front view of the force receiving member of FIG. 20 re-configured to fit around a person's hand or ankle.
Figure 23:
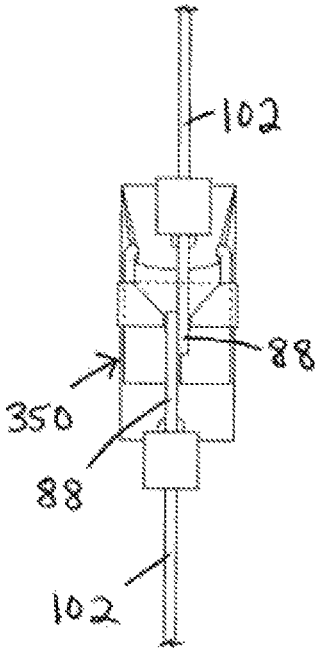
FIG. 23 is a front view of the force receiving member of FIG. 22 connected to diametrically opposed first and second resistance units like the shown in FIG. 6.

FIGS. 20 and 22 show another force receiving member 350 for selective connection to the carabiner 88 (and constructed according to the principles of the present invention). This so-called "hankie strap" 350 is sized and configured to comfortably fit about a person's hand and alternatively about a person's ankle. FIG. 21 shows the hankle strap during an intermediate step in the manufacturing process. FIG. 23 shows the hankle strap 350 configured for use and connected to two diametrically opposed resistance units 100*b* and 100*a* (not shown) via respective cords 102 and carabiners 88.

With reference to FIG. 21, the hankle strap 350 includes an elongate strap or nylon webbing 351 having (a) a first side (shown in FIG. 21) and an opposite second side (shown in FIG. 20) that define a thickness therebetween (perpendicular to the drawing sheet); (b) a first end and a second end that define a length therebetween (parallel to the length of the drawing sheet); and (c) a first edge and a second edge that define a width therebetween (parallel to the width of the drawing sheet). A patch 352 of hook-type fasteners is secured to the first side of the strap 351 proximate the first end. A patch 353 of loop-type fasteners is secured to the first side adjacent to the patch 352 of hook-type fasteners and spanning a majority of the strap 351, extending in both directions beyond the entire middle half of the strap 351. A relatively narrower (and shorter) strip or nylon webbing 354 has an intermediate portion that is sewn to the first side of the strap 351 proximate the second end. First and second ends of the strip 354 project outward beyond the width of the strap 352.

As shown in FIG. 20, a ring member 355, which is preferably a D-ring, rests against the second side of the strap 351, opposite the intermediate portion of the strip 354. A first end of the strip 354 is routed around a proximate curved portion of the ring member 355 and then away from the second end of the strap 351, where it is sewn to the second side of the strap 351. Similarly, a second end of the strip 354 is routed around a proximate curved portion of the ring member 355 and then away from the second end of the strap 351, where it is sewn to the second side of the strap 351. The arrangement is such that a relatively small, intermediate portion 356 of the ring member 355 is exposed in a gap between the first end of the strip 354 and the second end of the strip 354, and this gap may be expanded to a certain extent by spreading apart the ends of the strip 354. An opposite, straight half 357 of the ring member 355 is left exposed between the strip 354 and the second end of the strap 351.

As shown in FIG. 22, the hankle strap 350 may be arranged in a closed loop (about a person's hand or ankle) by routing the first end of the strap 351 around the exposed half 357 of the ring member 355 and then back against itself, at which point the patch 352 of hook-type fasteners overlies, faces toward, and engages the patch 353 of the loop-type fasteners. The patch 352 is relocated along the patch 353 to adjust the effective circumference of the looped hankle strap 350. The second end of the strap 351 extends beneath the ring member 355 to reduce discomfort a user may otherwise experience when a cord 102 pulls in various directions against the intermediate portion 356 of the ring 355 during exercise.

As shown in FIG. 23, one or more carabiners 88 may be clipped to the exposed curved portion 356 of the ring member 355 in the gap between the ends of the strip 354. In this case, two carabiners 88 are secured to the ring member 355, and the associated cords 102 extend in opposite directions away from the connection point (to respective resistance devices 100*a* and 100*b*).

Figure 12:
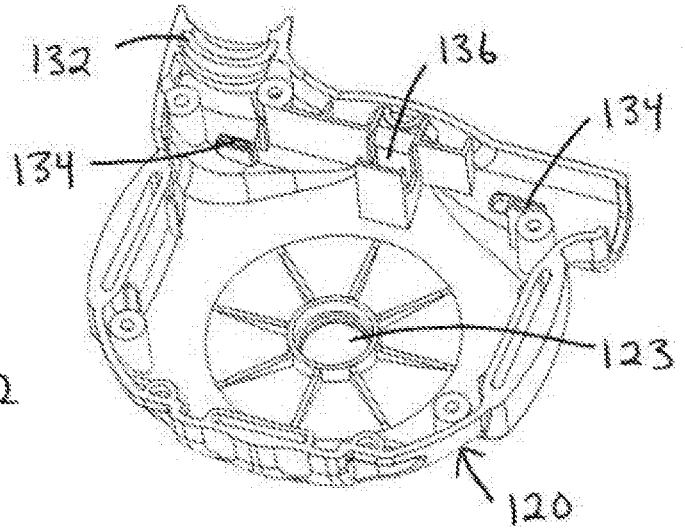
FIG. 12 is a perspective view of the interior of the front housing component of the exercise apparatus of FIG. 6.
Figure 14:
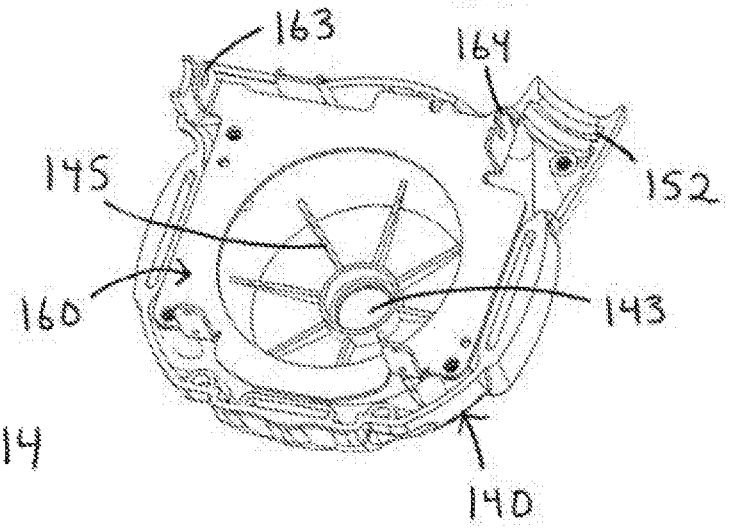
FIG. 14 is a perspective view of the interior of the rear housing component of the exercise apparatus of FIG. 6, with an associated bracket resting on top of it.
Figure 15:
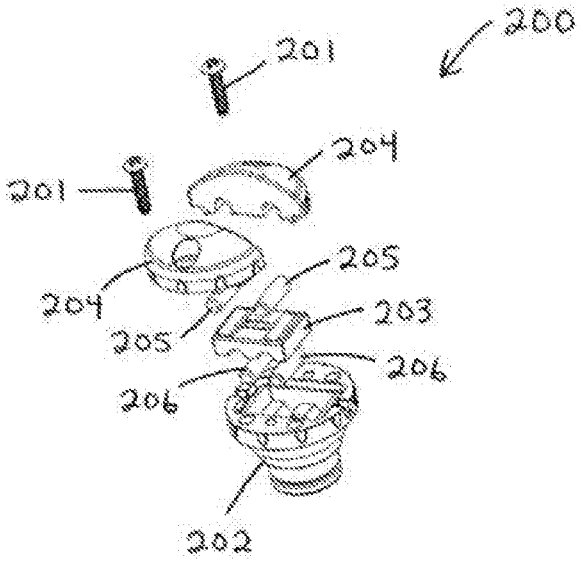
FIG. 15 is an exploded perspective view of a re-directional bearing that is part of the exercise apparatus of FIG. 6.

Components of the re-directional bearing 200 are shown in greater detail in FIG. 15. A commercially available annular bearing pack is press-fit onto a lower "stem" member 202 of the re-directional bearing, and then a conventional C-clip is squeezed onto the lower stem member 202 to retain the bearing pack against axial movement relative thereto. As shown in FIG. 12, the front housing 120 defines a semi-cylindrical receptacle 132 to receive one half of the bearing pack, and as shown in FIG. 14, the rear housing 140 similarly defines a semi-cylindrical receptacle 152 to receive the other half of the bearing pack. The bearing pack accommodates rotation of the stem member 202 about an axis relative to the shell 110.

A middle insert or member 203 of the re-directional bearing 200 is sized and configured to "key" into an upwardly opening compartment in the stem member 202. When installed relative thereto, the insert 203 cooperates with the stem member 202 to define receptacles configured and arranged to rotatably support a lower pair of parallel first and second steel roller pins 206.

Identical first and second top members 204 of the re-directional bearing 200 are sized and configured to "key" into place on top of the stem member 202 (with the insert 203 trapped therebetween). The top members 204 cooperate with the insert 203 to define receptacles configured and arranged to rotatably support an upper pair of parallel first and second steel roller pins 205. The top members 204 are secured to the stem member 202 by respective screws 201. Depending on design considerations, it may be desirable to make the top members 204 from a relatively tougher type of plastic and/or to occasionally replace these top members 204 due to the extensive sliding contact they experience with the cords 102.

Figure 8:
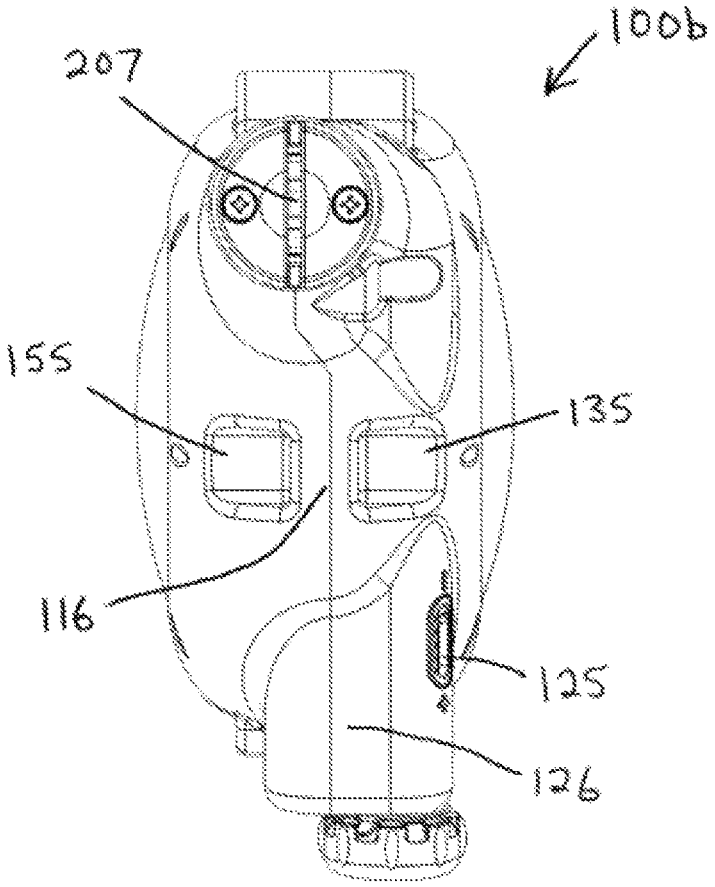
FIG. 8 is a nearly top view of the resistance module of FIG. 6, with the module angled ten degrees from vertical to present a true top view of a re-directional bearing component of the module.

As shown in FIG. 8, the top members 204 are spaced apart from one another in a manner that defines a gap or slot 207 therebetween. In the space between the upper roller pins 205, the slot 207 aligns with slots of similar width extending through the insert 203 and the stem member 202, thereby defining a passageway for the cord 102. In other words, the cord 102 is routed downward between the upper roller pins 205, then between the lower roller pins 206, and then through the base 202. The components of the re-directional bearing 200 cooperate to accommodate pulling of the cord 102 anywhere in a hemispherical space centered about the rotational axis of the re-directional bearing 200 and bounded by a plane defined by the exposed interface between the stem portion 202 and the housings 120 and 140 (and to some extent beyond said plane).

The upper roller pins 205 are spaced relatively further apart than the lower roller pins 206, and axially inward portions of the lower roller pins 206 are visible beneath the upper roller pins 205 in FIG. 8. The upper roller pins 205 are spaced relatively far apart from another to encourage rotation of the re-directional bearing 200 into an orientation where the slot 207 aligns with the direction in which the cord 102 is being pulled. On the other hand, the lower roller pins 206 are spaced relatively closer together to keep the cord 102 from riding against respective sidewalls of the sheave 180 when the cord 102 is pulled in any direction, especially substantially perpendicular to the bracket 160. In other words, when the slot 207 on the re-directional bearing 200 extends perpendicular to the cord groove 182 defined by the sheave 180 (rotated 90 degrees relative to the orientation shown in FIGS. 8 and 11), the interior edges of the lower pins 206 are inboard relative to the interior sidewalls of the groove 182, so the cord 102 does not ride on a sidewall of the groove 182 as it is being wound or unwound from the sheave 180.

The sheave 180 is injection molded plastic and includes two axially discrete sections. On the more interior half of the sheave 180, closer to the bracket 160 and shown in FIG. 17, the sheave 180 includes opposing sidewalls that define the groove 182 therebetween. An opening 184 extends into the side of the sheave 180 and intersects the base wall of the groove 182 to facilitate securing the inner end of the cord 102 to the sheave 180, preferably by means of at least one knot in the inner end of the cord 102. The cord 102 then winds about the base of the groove 182 and thereafter about itself.

Concentrically inward from the groove 182, a conventional one-way clutch bearing 186 is press-fit into a hexagonal bearing sleeve 188, which in turn is press-fit into a hub portion of the sheave 180. The clutch bearing 186 is sized and configured to receive a steel cylindrical shaft 300 (see FIG. 11) in such a manner that the sheave 180 rotates together with the shaft 300 when the cord 102 is pulled from the sheave 180, and the sheave 180 rotates relative to the shaft 300 when the cord 102 is wound back onto the sheave 180 (by a re-wind spring discussed below).

Figure 11:
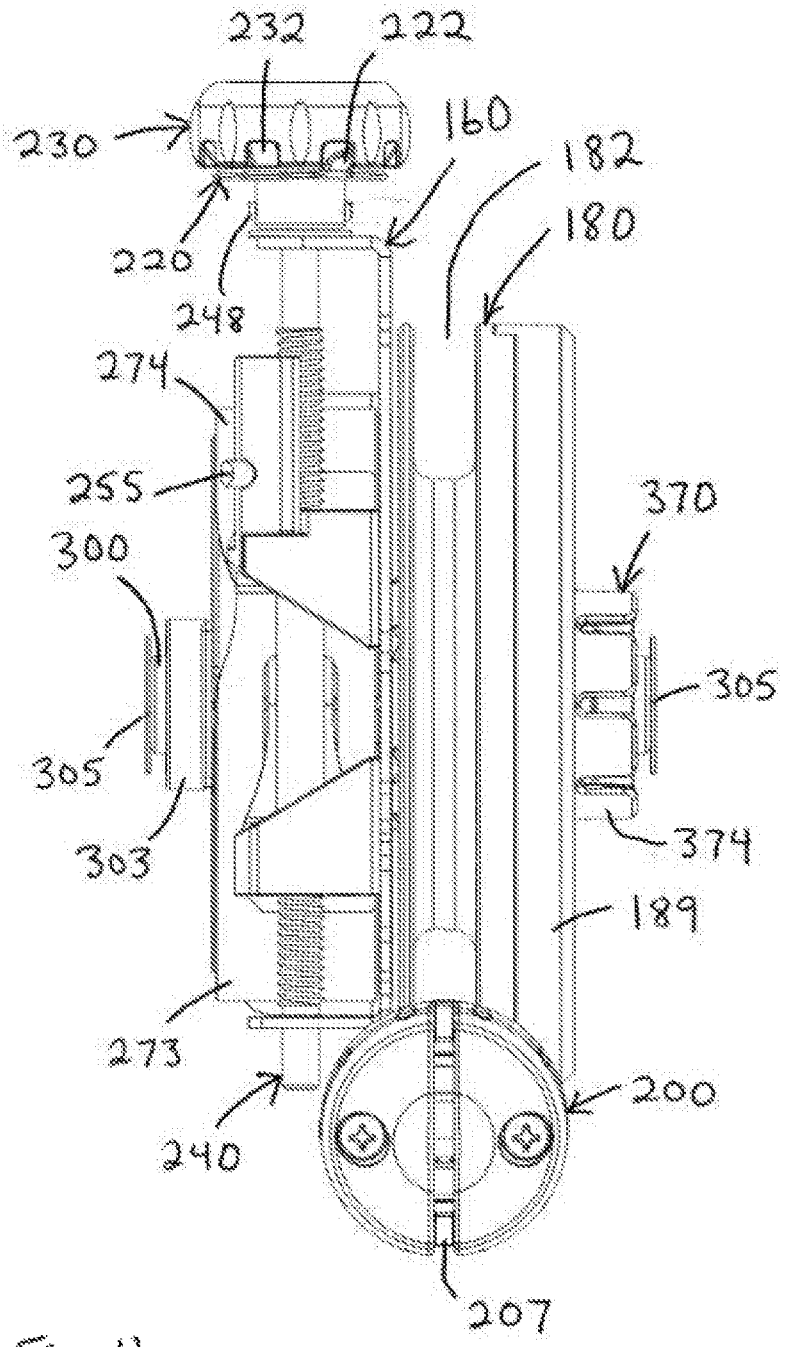
FIG. 11 is a top view of the resistance module of FIG. 6, but with the front and rear housing components removed to illustrate various interior components.
Figure 16:
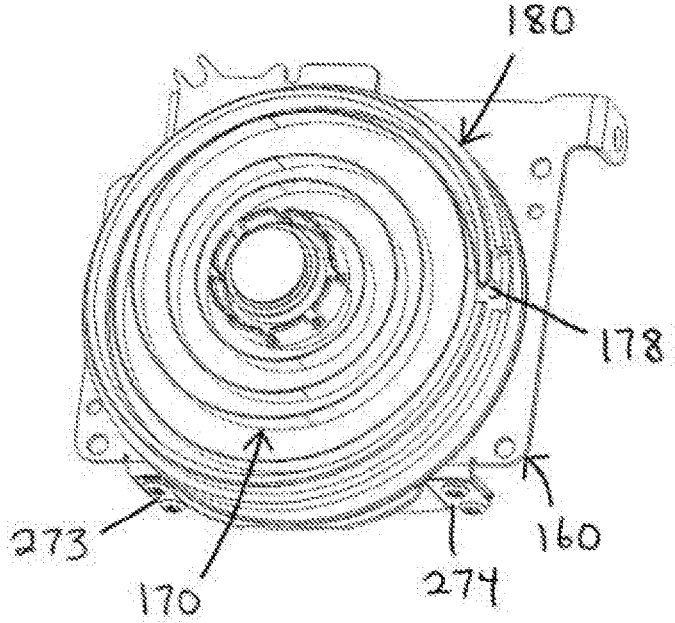
FIG. 16 is a perspective view of certain internal components of the exercise apparatus of FIG. 6, including a generally opposite view of the bracket of FIG. 14.

On the more exterior half of the sheave 180, further from the bracket 160 and shown in FIG. 16, the sheave 180 defines an outwardly opening cylindrical compartment sized and configured to accommodate a spiral wound recoil spring 170. As shown in FIG. 11, an injection molded plastic cover 189 is secured to the sheave 180 to enclose the spring 170 in this compartment. As shown in FIG. 16 a radially outer end 178 of the spring 170 is connected to the peripheral wall of the compartment defined by the sheave 180 and trapped in place by the cover 189. An opposite, radially inner end of the spring 170 is connected to the rear housing 140 via a spring bushing 370 (shown in FIGS. 11, 13, and 16).

The spring bushing 370 is injection molded plastic and includes two axially discrete sections. On the more interior half of the spring bushing 370, closer to the bracket 160 and shown more prominently in FIG. 13, the spring bushing 370 has a relatively smaller diameter hub portion 377. The hub portion 376 defines an opening 377 sized and configured to receive and retain the inner end of the spring 170. The hub portion 376 also defines an otherwise uninterrupted round surface about which the spring 170 can coil. Making efficient use of limited space, this cylindrical surface accommodates the inner end of the spring 170 and relatively strain-free winding and unwinding of the spring 170, while being non-concentrically disposed about the shaft 300.

Figure 13:
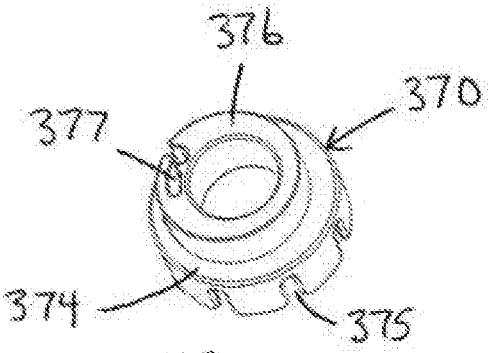
FIG. 13 is a perspective view of a spring bushing that is part of the exercise apparatus of FIG. 6.

On the more exterior half of the spring bushing 370, further from the bracket 160 and shown more prominently in FIGS. 11 and 16, the spring bushing 370 includes a relatively larger diameter exposed end 374. The exposed end 374 is cylindrical in shape and is concentrically disposed about the shaft 300. With reference to FIGS. 13-14, circumferentially spaced and diametrically opposed slits 375 in the spring bushing 370 are sized and configured to engage similarly spaced ribs 145 on the interior of the rear housing halve 140. The slits 375 and the ribs 145 cooperate to "key" the spring bushing 370 in any of eight possible orientations relative to the rear housing 140. As a result of this arrangement, the spring 170 biases the cord 102 toward a retracted state within the shell 110 and wound about the sheave 180. The extent to which the spring biases 170 the sheave 180 to rotate in a rewind direction relative to the shaft 300, and/or resists rotation of the sheave 180 together with the shaft 300 when the cord 102 is pulled from the sheave 180, may be adjusted by changing the orientation of the spring bushing 370 relative to the rear housing half 140.

As shown in FIGS. 12 and 14, each housing 120 and 140 defines a respective, reinforced receptacle 123 or 143 that is sized and configured to receive and retain a respective, conventional roller bearing assembly 303 (see FIG. 11). Each roller bearing assembly 303 is sized and configured to rotatably support a respective end of the shaft 300. Teflon discs 305 are preferable sandwiched between the ends of the shaft 300 and respective housings 120 and 140.

As shown in FIG. 11, a brake assembly is disposed forward of the bracket 160 (opposite the sheave 180). Components of the brake assembly are shown by themselves in FIGS. 18-19. A brake drum 190 is rigidly mounted on the shaft 300 between the sheave 180 and the front end of the shaft 300. Teflon washers are preferably positioned between parts that rotate relative to one another during any phase of operation, including between the brake drum 190 and the sheave 180.

Figure 18:
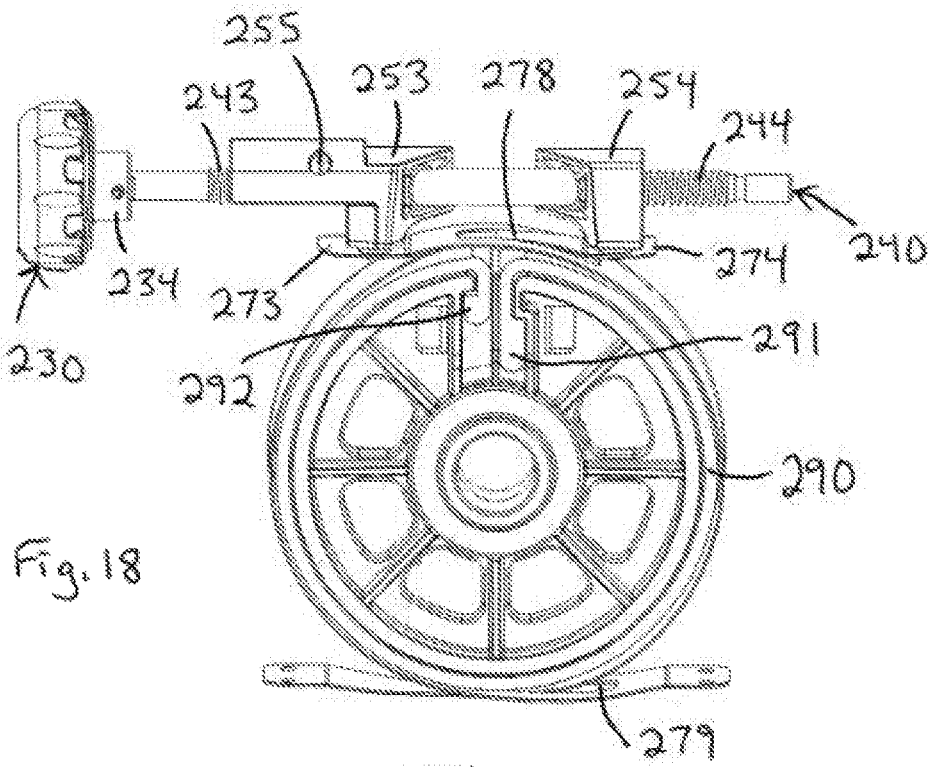
FIG. 18 is a perspective view of certain components of the exercise apparatus of FIG. 6.

The brake drum 190 is injection molded plastic and is keyed to the shaft 110 and thereby constrained to rotate together with the shaft 110. In this regard, a hole extends transversely through the shaft 300, and a pin is inserted through the hole in the shaft 300. On the side opposite what is shown in FIGS. 18-19, the brake drum 190 includes a radially extending slot to receive and lock onto the pin when the pin is pushed half-way through the hole in the shaft 300.

Figure 19:
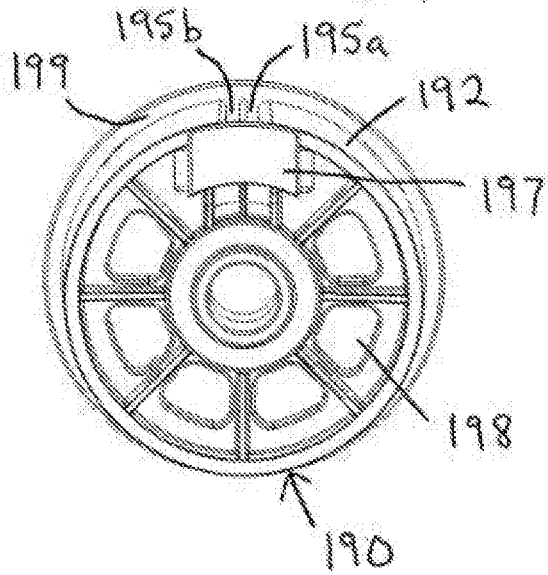
FIG. 19 is a generally similar perspective view of a brake drum component shown in FIG. 18.

As shown in FIG. 19, the brake drum 190 defines a circumferential perimeter or bearing surface 192 that is interrupted by a slot divided into two discrete sections 195*a* and 195*b*, or alternatively, by adjacent first and second slots 195*a* and 195*b*. As shown in FIG. 18, a braking strip 290 is mounted on the drum 190. The braking strip 290 is preferably a Kevlar strap or web having a first end portion 291 that is folded against itself and sewn into a doubly thick end, and an opposite, second end portion 292 that also is folded against itself and sewn into a doubly thick end.

A radially outward end of the first slot 195*a* is slightly thinner than the thickness of the braking strip 290, and an opposite, radially inward end of the first slot 195*a* is at least twice as wide as the outward end. The doubled over first end 291 of the braking strip 290 is press fit into the inner end of the first slot 195*a*, and the adjacent thinner portion of the braking strip 290 is press fit into the outer end of the first slot 195*a*. The subsequent adjacent portion of the braking strip 290 is wrapped around the perimeter 192 of the drum 190, beginning in a direction moving away from the second slot 195*b*.

A radially outward end of the second slot 195*b* is wider than the thickness of the braking strip 290, and an opposite, radially inward end of the second slot 195*b* is at least twice as wide as the outward end. The doubled over second end 292 of the braking strip 290 is loosely located inside the inner end of the second slot 195*b*, and the adjacent thinner portion of the braking strip 290 is loosely located inside the outer end of the second slot 195*b*. The braking strip 290 can be relatively taut (from end to end) after being installed in this manner. In operation, the first slot 195*a* pulls the wrapped portion of the braking strip 290 through circles in response to withdrawal of the cord 102 from the sheave 180, and the second slot 195*b* accommodates stretch in the braking strip 290 during use and/or over time.

As shown in FIG. 19, a radially extending rim or flange 199 bounds an inboard edge of the drum perimeter 192 to discourage the braking strip 290 from drifting inboard. Also, a cap 197 is secured to an opposite, outboard side of the drum 190 to cover the slots 195*a* and 195*b* and discourage the braking strip 290 from drifting outboard. The cap 197 snaps into place via holes 198 adjacent to walls bordering the slots 195*a* and 195*b*. Persons skilled in the art will recognize that the other means, including adhesives or screws, for example, may be used in lieu of or in addition to the snap fit arrangement.

For strength and manufacturing efficiency, the drum 190 is cored to an extent, and additional holes 198 extend through an intermediate section of the drum 190. At least some of the holes 198 align with a cord tie-off point associated with the sheave 180, thereby providing access for replacing the cord 102 with a new cord 102, if and when needed.

As shown in FIG. 18, a first tension band 273 is secured in a generally U-shaped configuration about one-half of the braking strip 290 and underlying perimeter 192 of the drum 190, and a second tension band 274 is secured in a generally U-shaped configuration about an opposite half of the braking strip 290 and underlying perimeter 192 of the drum 190. Each tension band 273 and 274 is preferably a strip of stainless spring steel that is formed into a stable, generally U-shaped configuration prior to installation on the unit 100*b*.

As shown in FIG. 16, a first end of the first tension band 273 is anchored to an anchor tab near a lower left corner of the bracket 160, and extending perpendicularly forward from the main body of the bracket 160. Similarly, a first end of the second tension band 274 is anchored to an identical anchor tab near a lower right corner of the bracket 160. In this regard, first and second holes extend through each tab, and comparable holes extend through the first end of each tension band 273 and 274. Pairs of first and second screws (shown in FIG. 16 but not labeled) insert through respective tension bands 273 and 274 and thread into respective holes.

As shown in FIG. 18, an opposite, second end of the first tension band 273 is anchored to an adjustment member or nut 253 by means of comparable holes in the nut 273 and the second end of the first tension band 273, and identical first and second screws. Similarly, an opposite, second end of the second tension band 274 is anchored to an adjustment member or nut 254 by means of comparable holes in the nut 274 and the second end of the second tension band 274, and identical first and second screws. Each adjustment nut 253 and 254 preferably includes a respective threaded brass insert that is over-molded with injection molded plastic.

Proximate a "6:00 position" in FIG. 18, the second tension band 274 is interrupted by a centrally located slot 279 near the end of the second tension band 274 that connects to the bracket 160. Proximate a "12:00" position in FIG. 18, a similar slot interrupts the first tension band 273 near the end of the first tension band 273 that connects to the adjustment nut 253. Proximate a "12:00 position" in FIG. 18, the second tension band 274 is interrupted by inwardly tapering edges that define a narrower width segment 278 near the end of the second tension band 274 that connects to the adjustment nut 254. Proximate a "6:00 position" in FIG. 18, a similar narrower width segment interrupts the first tension band 273 near the end of the first tension band 273 that connects to the bracket 160. Each narrower width segment is inserted through an opposing slot to "bypass" the bands 273 and 274 relative to one another and form a mostly closed loop of uninterrupted brake band material about the braking strip 290 and the underlying perimeter 192 of the drum 190.

A third adjustment member or bolt 240 has a first section 243 provided with right hand threads and an opposite, second section 244 provided with left hand threads. The first nut 253 is threaded onto the first section 243 of the adjustment bolt 240, and the second nut 254 is threaded onto the second section 244 of the adjustment bolt 240. Each nut 253 and 254 is configured to define one or more bearing surfaces to bear against adjacent bearing surfaces on the frame 110, including for example, respective portions of the bracket 160 and/or the front housing 120.

The adjustment bolt 240 is rotatably mounted on the bracket 160. With reference to FIG. 14, the first end of the adjustment bolt 240 (proximate the end of the first section 243) inserts through a hole in a support tab 163 on the bracket 160, which extends perpendicularly forward from the main body of the bracket 160. As further described below, a knob is mounted on the distal first end of the bolt 240. An opposite, second end of the adjustment bolt 240 (proximate the end of the second section 244) is provided with a smaller radius groove to fit into a slot in another support tab 164 on the bracket 160. As shown in FIG. 12, internal members 134 and 136 on the front housing 120 are configured and arranged to bear against smooth portions of the adjustment bolt 240 as needed to prevent the adjustment bolt 240 from rising out of the slot 179.

With reference to FIGS. 11 and 18, the knob 230 is rigidly secured to the first end of the bolt 240, with a Teflon washer disposed on the first end of the bolt 240 between the knob 230 and the anchor tab 163. The knob 230 and the groove in the opposite end of the bolt 240 cooperate to prevent axial movement of the bolt 240 relative to the bracket 160. The arrangement of the nuts 253 and 254 and the bolt 240 is such that the nuts 253 and 254 move away from one another when the bolt 240 is rotated in a first direction, and move toward one another when the bolt 240 is rotated in an opposite, second direction. In other words, from the perspective of a person to the left of the knob 230 in FIG. 18, rotation of the knob 230 in a clockwise direction causes the nuts 253 and 254 to move away from one another, thereby increasing resistance to rotation of the drum 190, and rotation of the knob 230 in a counter-clockwise direction causes the nuts 253 and 254 to move toward one another, thereby decreasing resistance to rotation of the drum 190.

The knob 230 is an assembly of two injection molded parts. As shown in FIGS. 11 and 18, the knob 230 includes a primary member having a relatively larger diameter outer end that is configured to be grasped and turned by a user, and a relatively smaller diameter inner end 234. The inner end 234 is keyed to the bolt 240, and pinned to the bolt 240 by a spring pin 248. A separate pointer member 220 has an annular base that is rotatably mounted on the inner end 234 of the knob 230, and a tab 222 that projects radially outward from the annular base. The annular base is shaped like a hyperbolic paraboloid and is resiliently squeezed toward a relatively flatter configuration between the larger end 232 of the knob 230 and the proximate sidewall of the shelf 110 (see FIG. 6). The tab 222 is sized and configured to occupy any of several notches 232 formed in the back side of the larger end of the knob 232, and the leaf spring nature of the pointer member 220 encourages the tab 222 to remain in any given notch 232. The tab 222 is selectively rotated relative to the knob 230 (and the bolt 240) to recalibrate the orientation of the tab 222 in relation to the current resistance setting (in increments of 45 degrees).

Figure 6:
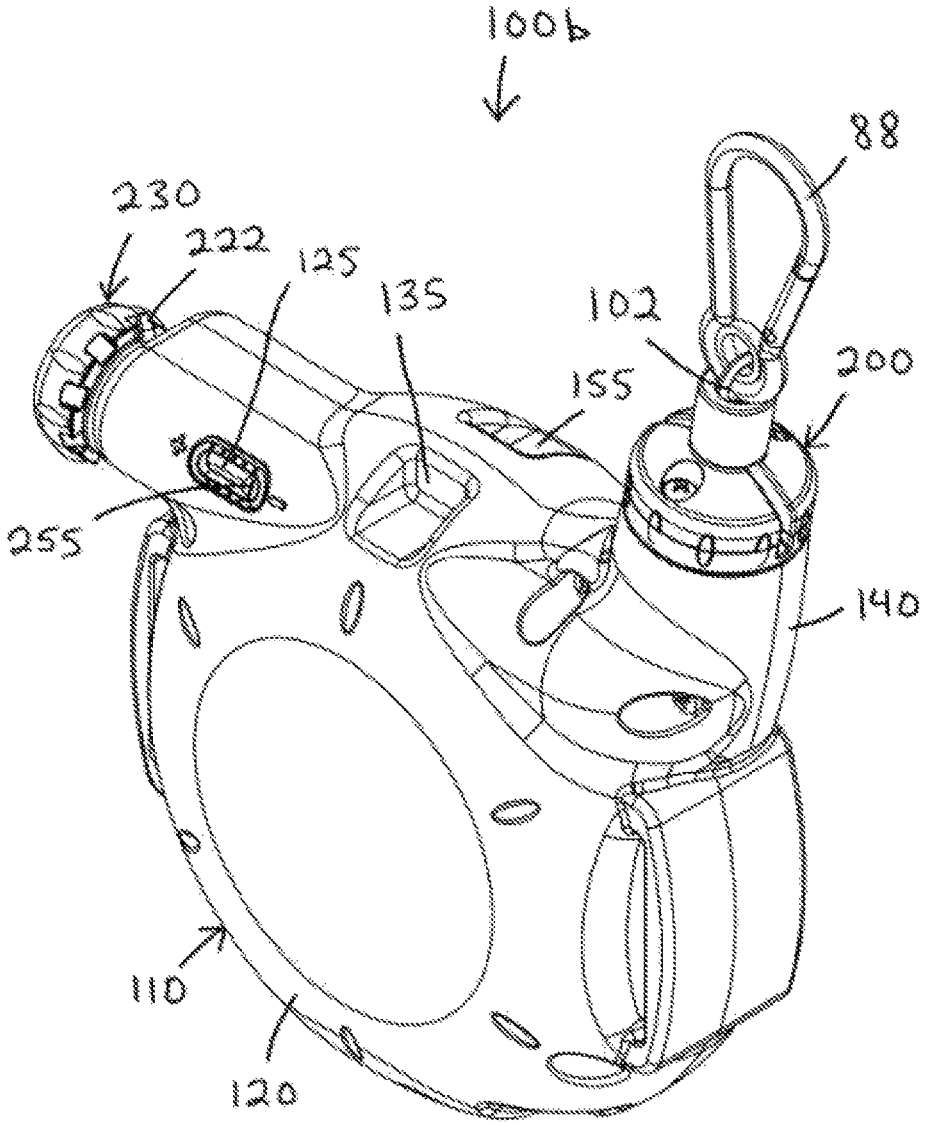
FIG. 6 is a perspective view of a resistance module that is constructed according to the principles of the present invention, and that is a component of the exercise apparatus of FIG. 1.

As shown in FIG. 6, a different sort of pointer member 255 is an integral portion of the adjustment nut 253. As a result, the pointer 255 travels linearly together with the nut 253. The pointer 255 is visible through a slot 125 in the front housing 120, and the position of the pointer 255 relative to the hash marks indicates a relative range of resistance associated with a revolutionary increment of the knob 230. In other words, the location of the pointer 255 provides a macro reading of relative resistance, and the orientation of the tab 222 provides a micro reading of relative resistance (within a given revolution of the knob 230). Each time the knob 230 goes through a revolution, the tab 222 returns to the same orientation, but the pointer 255 moves to a different position relative to the hash marks adjacent to the slot 125. The adjustability of the tab 222 relative to the knob 230 allows one unit 100*b* to be calibrated relative to another unit 100*a*.

On an alternative embodiment, the pointers 222 and 255 are replaced be an electronic display, a controller, and a power supply. With reference to FIG. 8, the electronic display may take the place of the slot 125 and/or occupy the area designated as 126, with the controller and the power supply disposed internally nearby between the bracket 160 and the rear housing 140. The controller is connected to at least two externally accessible buttons, as well as a conventionally available sensor that tracks rotation of the knob 230. The following flow chart outlines one possible operating routine for the controller:

When Unit Status is: OFF

1. If Power Button is pushed,
Turn Unit ON

When Unit Status is: ON

1. Display Current Resistance Setting (as a percentage from 03 to 99 in increments of 3)
2. If Power Button is pushed,
a. Save Current Resistance Setting, and
b. Turn OFF Unit
3. If Knob is rotated clockwise,
Add 3 to the Current Resistance Setting for every ⅛ of a revolution (up to a MAX of 99).
4. If Knob is rotated counter-clockwise,
Subtract 3 from the Current Resistance Setting for every ⅛ of a revolution (down to a MIN of 03).
5. If Other button is pushed,
Initiate protocol for recalibrating resistance range and/or recalibrating one Unit with another Unit.

The recalibration protocol may take various approaches, may give the user the option of choosing a particular approach, and/or may blend multiple approaches. For example, one protocol would be to prompt the user to set the resistance at maximum and then push the Other button. During subsequent use, the controller would start the display at 99 and then adjust the figure accordingly in response to rotation of the knob. Another protocol would be to prompt the user to set the resistance just above minimum and then push the Other button. During subsequent use, the controller would start the display at 06 and then adjust the figure accordingly in response to rotation of the knob. Yet another protocol would prompt the user to do both of the foregoing in sequential order to establish a range of rotation to adjust from maximum to minimum resistance.

If a direct relationship to pounds of force is desired, another protocol would prompt the user to adjust resistance to the point where a 20-pound weight just begins to pull the cord straight downward out of the housing and then push the Other button. During subsequent use, the controller would start the display at 20 and then adjust the figure accordingly in response to rotation of the knob. Based on experimentation, 20 pounds would correspond to a percentile reading of 36, given that maximum resistance generated by a prototype of the depicted unit 100*b* is approximately 55 pounds.

If consistency between two units 100*a* and 100*b* is desired, then one unit 100*a* would be calibrated in one or more ways set forth above, and then interconnected with the other unit 100*b* to put the knob of the other unit in a similar position for one or more particular resistance setting(s).

Figure 25:
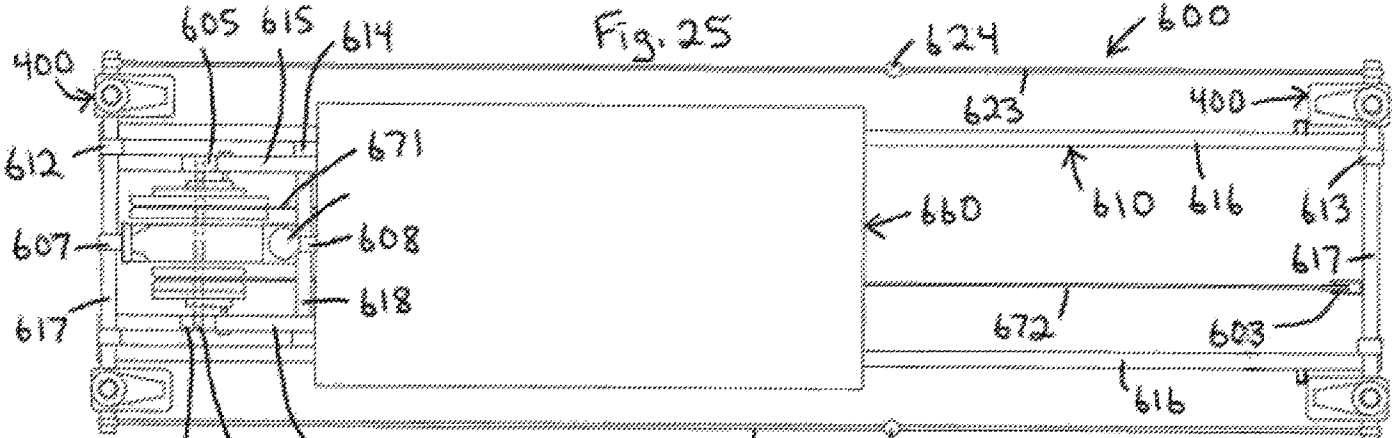
FIG. 25 is a top view of another exercise apparatus constructed according to the principles of the present invention, and suitable for use with as many as four units similar to that shown in FIG. 6.
Figure 26:
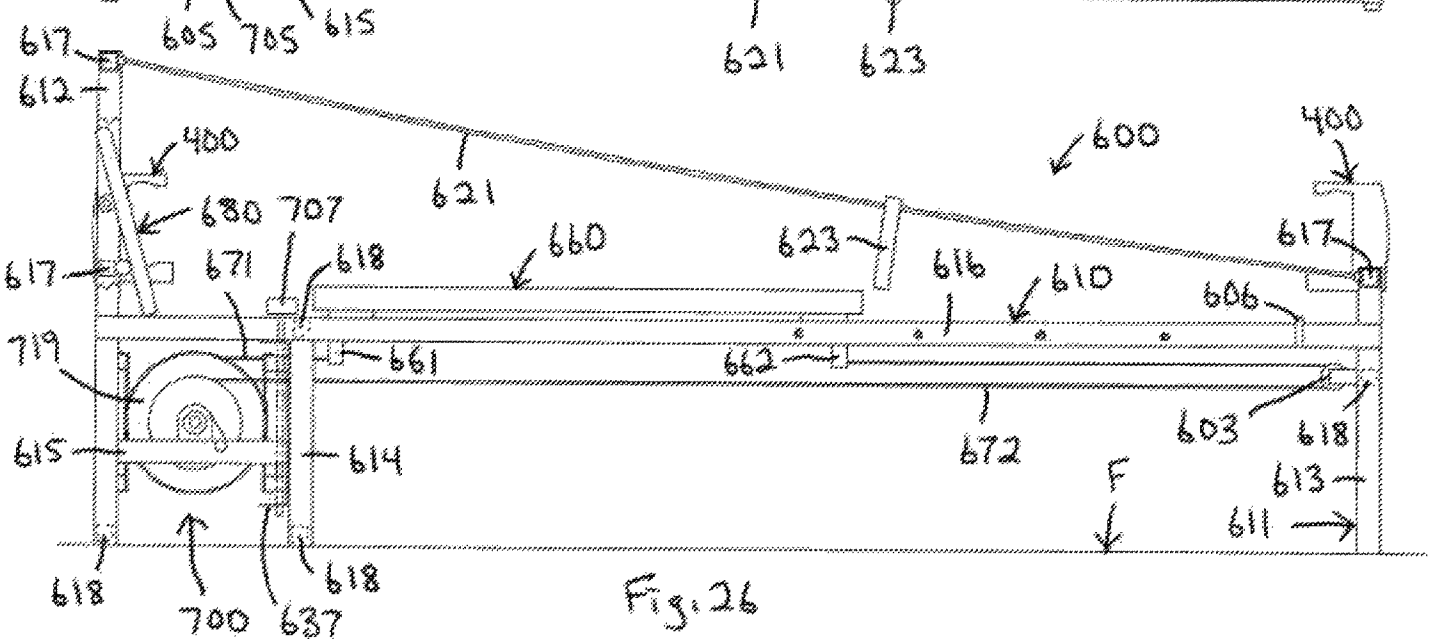
FIG. 26 is a side view of the exercise apparatus of FIG. 25.
Figure 27:
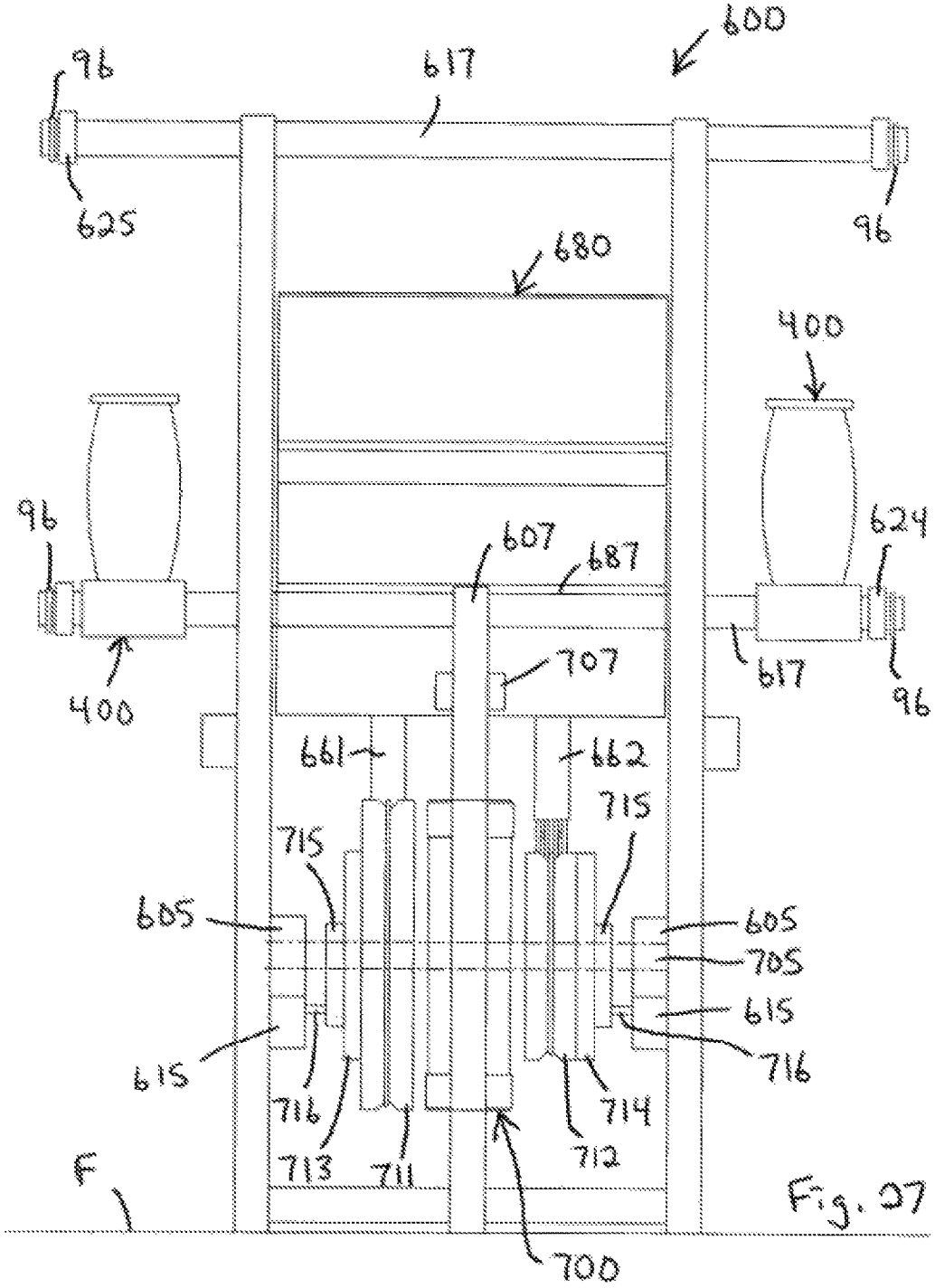
FIG. 27 is a front view of the exercise apparatus of FIG. 25.

FIGS. 25-27 show another exercise apparatus 600 constructed according to the principles of the present invention. In one respect, the apparatus 600 may be categorized as a reformer type of exercise equipment which is frequently associated with Pilates exercises. Examples of such equipment are disclosed in U.S. Pat. Nos. 5,792,033; 6,186,929; 6,371,895; 6,527,685; 6,685,606; 6,926,650; 6,971,976; 7,125,368; 7,125,369; 7,163,500; 7,179,207; 7,288,053; 7,288,054; 7,294,098; 7,465,261; 7,857,736; 8,152,705; and 8,157,714, all of which are incorporated herein by reference to provide supplemental disclosure regarding the construction, operation, and/or use of the present invention. In other respects, the apparatus 600 may be categorized as other types of exercise equipment and/or described in terms of various improvements that may implemented on their own and/or in connection with other exercise equipment already known in the art.

Generally speaking, the apparatus 600 includes a frame 610; a carriage or platform 660 rollably mounted on the frame 610 and sized and configured to support a person's body in various positions; hand grips 623 and 624 mounted on the frame 610 to be grasped in the person's hands for pushing and/or pulling while supported on the platform 660; a foot support 680 mounted on the frame 610 to receive a person's feet for pushing and/or pulling while supported on the platform 660; a first resistance assembly 700 mounted on the frame 610 to resist movement of the platform 660 relative to the frame 610; and a plurality of modular resistance devices 100*a* and 100*b* selectively mounted on the frame 610 to resist extraction of cords from such devices.

The frame 610 includes a rigid base 611 configured to rest in a stable position on an underlying floor surface F. The components of the base 610 are preferably made of steel and welded to one another at their places of intersection. The base 611 includes six vertically extending posts 612-614 (shown as 1" by 1.5" rectangular tubes of different lengths) which support two longitudinally extending horizontal and parallel rails 616. Two posts 612 are disposed at the front end of the apparatus 600 and extend the highest above the floor surface F. Two posts 613 are disposed at the opposite, rear end of the apparatus 600. Two posts 614 are disposed between the two ends, proximate the front end of the apparatus 600, and are shorter than the two posts 613.

Seven laterally extending, horizontal beams 617-618 (shown as 1" by 1" square tubes of different lengths) extend perpendicular to the rails 616 and are interconnected between respective pairs of laterally aligned posts 612-614. The three beams 617 shown in solid lines in FIG. 26 are longer than the four beams 618 shown in dashed lines in FIG. 26.

Two longitudinally extending, horizontal beams 615 (shown as 1"×1.5" rectangular tubes) extend parallel to the rails 616 and are interconnected between respective pairs of longitudinally aligned posts 612 and 614. Opposing left and right bearing mounts 605 are mounted on respective beams 615 to rotatably support a shaft 705 (shown in dashed lines in FIGS. 25 and 27) extending therebetween.

A forward, centrally located, vertical post or support 607 (shown as a 1"×1.5" rectangular tube) is interconnected between the shorter front beam 618 and the lower of the two longer front beams 617. A rearward, centrally located, vertical post or support 608 (also shown as a 1"×1.5" rectangular tube) is interconnected between the two intermediate beams 608. As further discussed below, support blocks 757 are mounted on the forward support 607, and a support bracket 748 is mounted on the rearward support 605.

The body supporting carriage or platform 660 is similar to body platforms disclosed in one or more of the "reformer" patents incorporated herein by reference, including U.S. Pat. No. 7,179,207, and it is rollably mounted on the rails 616 in a manner known in the art. It preferably includes a wood sheet that is reinforced by a steel frame and upholstered with padding sandwich between the top of the wood sheet and the top layer of the upholstery. The platform 660 is sized and configured to support a person in a supine position with his feet resting on the foot support 680, and his head resting on the end of the platform 660 opposite the foot support 680. FIGS. 25-26 show the platform 660 in a forwardmost position on the rails 616. A stop 606 is mounted on at least one of the rails 616 to limit rearward travel of the platform 660 just short of the rearward ends of the rails 616 (and just short of the module brackets 400). Holes extended laterally through the rails 616 to selectively align with a hole in the sub-structure of the platform 660 and receive a pin that locks the platform 660 in any of several positions along the rails 616.

Figure 28:
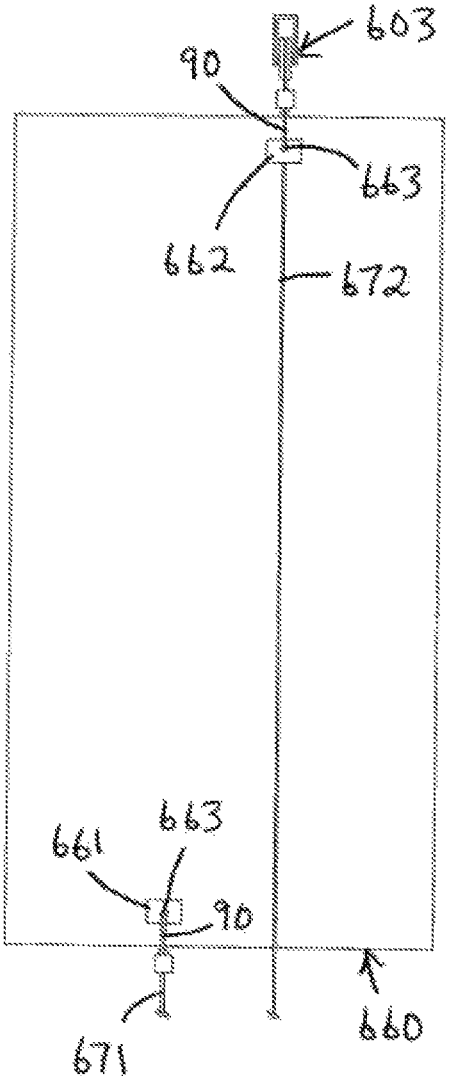
FIG. 28 is a bottom view of a body supporting platform that is a component of the exercise apparatus of FIG. 25.

FIG. 28 is a bottom view of the platform 660 and certain related components. A first support 661 (shown as a short segment of 1"×3" rectangular tube) is rigidly connected to the platform 660 proximate the front end of the platform, and extends downward below the rails 616 (as shown in FIG. 26). A second similar support 662 (shown as another short segment of 1"×3" rectangular tube) is rigidly connected to the platform 660 proximate the rear end of the platform, and similarly extends downward below the rails 616.

Each support 661 and 662 is open in the longitudinal front to rear direction, and a hole 663 extends through the lowermost wall of each support 661 and 662. A first cord 671 extends from a first end, which is connected to the resistance device 700, to a second end, which terminates in a carabiner 90. The carabiner 90 is clipped to the front support 661 via the hole 663. A second cord 672 extends from a first end, which is connected to the resistance device 700, through the rear support 662, then around a pulley 603 rotatably mounted on the base 611 proximate the rear end of the frame 610, and then to a second end, which terminates in another carabiner 90. This carabiner 90 is clipped to the rear support 662 via the hole 663. As a result of this arrangement, resistance to movement of the platform 660 away from the resistance device 700 is transmitted through the first cord 671, and resistance to movement of the platform 660 toward the resistance device 700 is transmitted through the second cord 672. Resistance in either direction may be selectively "deactivated" by unclipping a respective carabiner 90 from the platform 660 and alternatively clipping it to a proximate portion of the frame 610.

Figure 29:
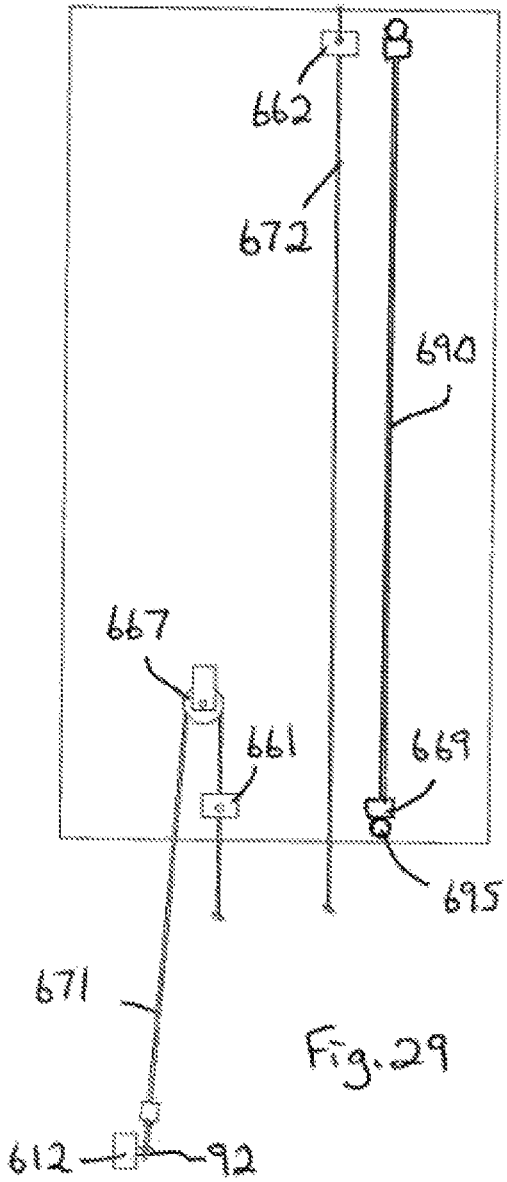
FIG. 29 is a bottom view of an alternative platform that may be substituted for the one shown in FIG. 28.

FIG. 29 shows an alternative cord configuration relative to the platform 660, as well as a supplemental force imposing member 690. In this configuration, the first cord 671 is routed from the resistance device 700, through the front support 661 and around a pulley 667 mounted on an intermediate portion of the platform 660, to the carabiner 90, which is clipped to a conventional eyebolt 92 secured to the frame member 612. This alternative arrangement doubles resistance to movement of the platform away from the resistance device.

The force imposing member 690 is similar to items disclosed in one or more of the "reformer" patents incorporated herein by reference, including U.S. Pat. No. 7,179,207. The member 690 is a bungee cord having a stop 695 secured to each end. Front and rear brackets 669 are mounted on respective ends of the platform 660 to receive and retain respective stops 669 with a relatively small amount of tension in the bungee cord 690. The bungee cord 690 is selectively "activated" by securing the front stop 695 to a proximate portion of the frame member 618 nearest the adjustment knob 707. When activated, the bungee cord 690 more aggressively biases the platform 660 toward the front of the machine 600.

Figure 30:
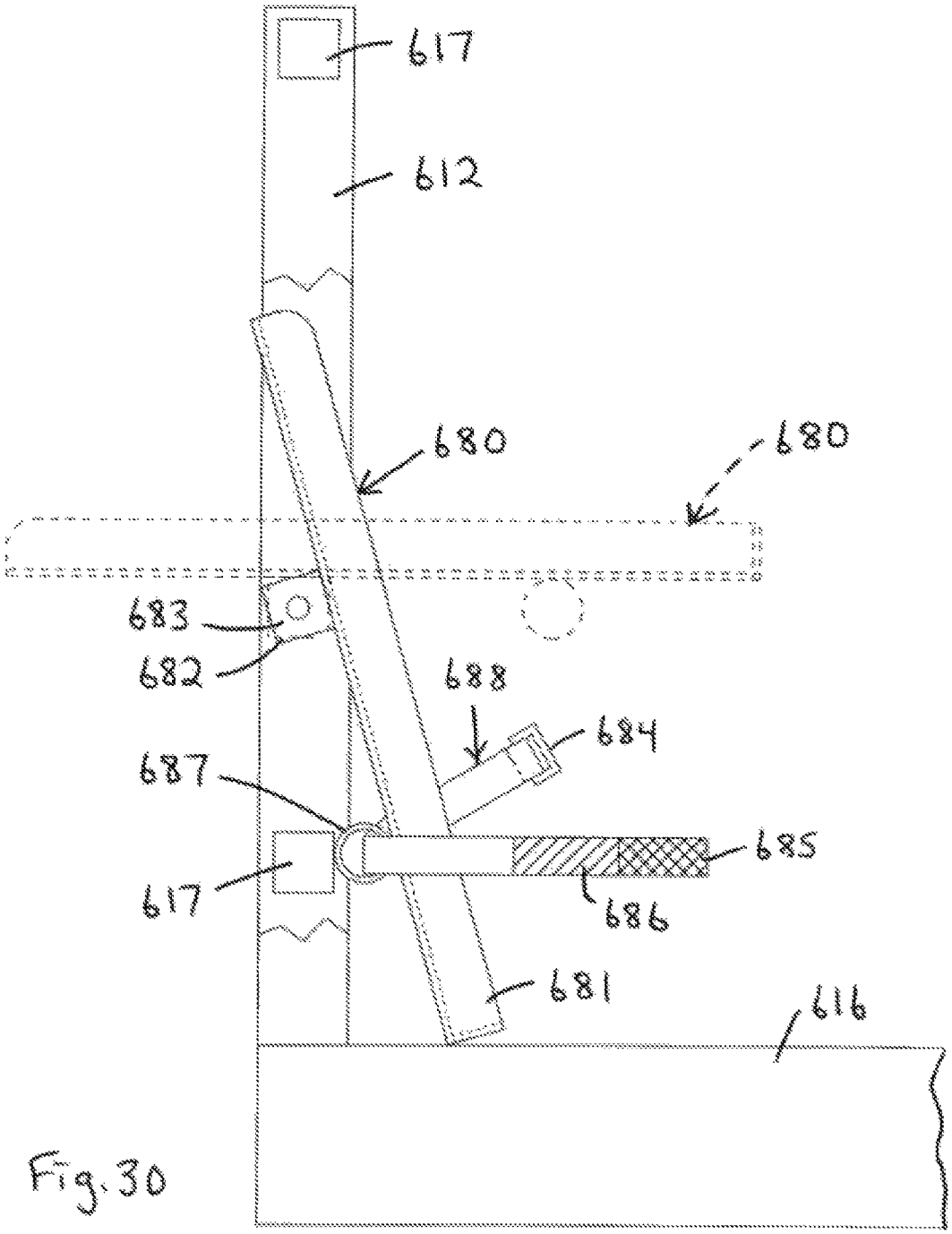
FIG. 30 is an enlarged side view of the upper front end of the exercise apparatus shown in FIG. 26, including a foot supporting platform that is a component thereof.

FIG. 26 shows the foot platform 680 pivotally interconnected between the forward posts 612 (it is not shown in FIG. 25 to better illustrate other components). FIG. 30 is an enlarged image of the upper forward portion of the apparatus 600 shown in FIG. 26, including the foot platform 680. The depicted foot platform 680 may be described as a steel plate 681 having a width of approximately 13 inches and a height of approximately 13 inches. The left, right, and lower edges of the plate 681 are bent at right angles to provide sidewalls about the outer sides and heels of a person's feet.

A cross bar 682 (shown as a 1"×1" square tube) is welded beneath the plate 681 approximately seven inches above the lower edge of the plate 681. The tube 682 reinforces the plate 681, and plugs 683 in the ends of the tube 682 accommodate pivotal connection of the foot platform 680 to the base 611. In this regard, a bolt (not shown) extends through both posts 612 and the plugs 683, and is secured in place by a mating nut (not shown).

Another cross bar 687 (shown as a 1" diameter round tube) is welded beneath the plate 681 nearer to the lower edge of the plate 681 and similarly reinforces the plate 681. The cross bar 687 engages the adjacent beam 617 to stop or limit forward (and downward) pivoting of the lower end of the foot platform 680. The stop also may be imposed by the lower end of the plate 681 bearing against the base 611, for example. In any event, the stop cooperates with the bolt to provide a stable foot platform (at an angle of 15 degrees from vertical) against which a person may press his feet during a leg press exercise.

A foot strap 688 made of nylon webbing or other suitable material has an intermediate portion that extends through the cross bar 687. A buckle 684 is connected to a first end of the foot strap 688, and respective patches of hook-type fasteners 685 and loop-type fasteners 686 are secured to an opposite, second end. When a person's feet are resting flat against the foot platform 680, the foot strap 688 is secured across the fronts of the person's ankles by inserting the second end through the buckle 684 and then folding it back onto itself to connect the hook-type fasteners 685 to the loop-type fasteners 686.

The foot strap 688 and/or the lip at the bottom edge of the foot platform 680 enable a person to pull his feet against the foot platform 680 during a leg curl exercise. As shown by dashed lines in FIG. 30, the lower end of the foot platform 680 remains free to pivot rearward (and upward) through a range of 75 degrees, thereby allowing a person to better engage his hamstring muscles during the leg curl exercise.

As shown in FIGS. 25-26, the frame 610 includes a first flexible frame member 621 interconnected between a left pair of front and rear posts 612 and 613, and a second flexible frame member 622 interconnected between a right pair of front and rear posts 612 and 613. In other words, each flexible frame member 621 and 622 may be described as a cord having a first portion connected to the base 611 proximate the foot end of the base 611; a second portion connected to the base 611 proximate the head end of the base 611; and an intermediate portion extending therebetween with preferably minimal slack.

With reference to FIG. 27, each end of each cord 621 and 622 (the cords themselves are not shown in view) is secured to a square ring 625 sized and configured to slide onto the beams 617. Near each end of each beam 617, a hole extends vertically through the beam 617 to receive one prong of a U-shaped pin 96, with the other prong abutting an outside wall of the beam 617. An alternative arrangement is to secure carabiners 90 to the ends of the cords 621 and 622; secure conventional eyebolts 92 in the holes currently accommodating the pins 96; and selectively clip the carabiners 90 to the eyebolts 92.

At least one left hand grip 623 is secured to the first cord 621 at one of several locations along its intermediate portion. For each left-hand grip 623, a separate right hand grip 624 is preferably secured to the second cord 622 at one of several locations along its intermediate portion. In this regard, persons skilled in the art will recognize that more hand grips 623 and 624 may be connected to respective cords 621 and 622, if desired.

Figures 31, 32, 33, 34, 35, 36, 37, 38, 39:
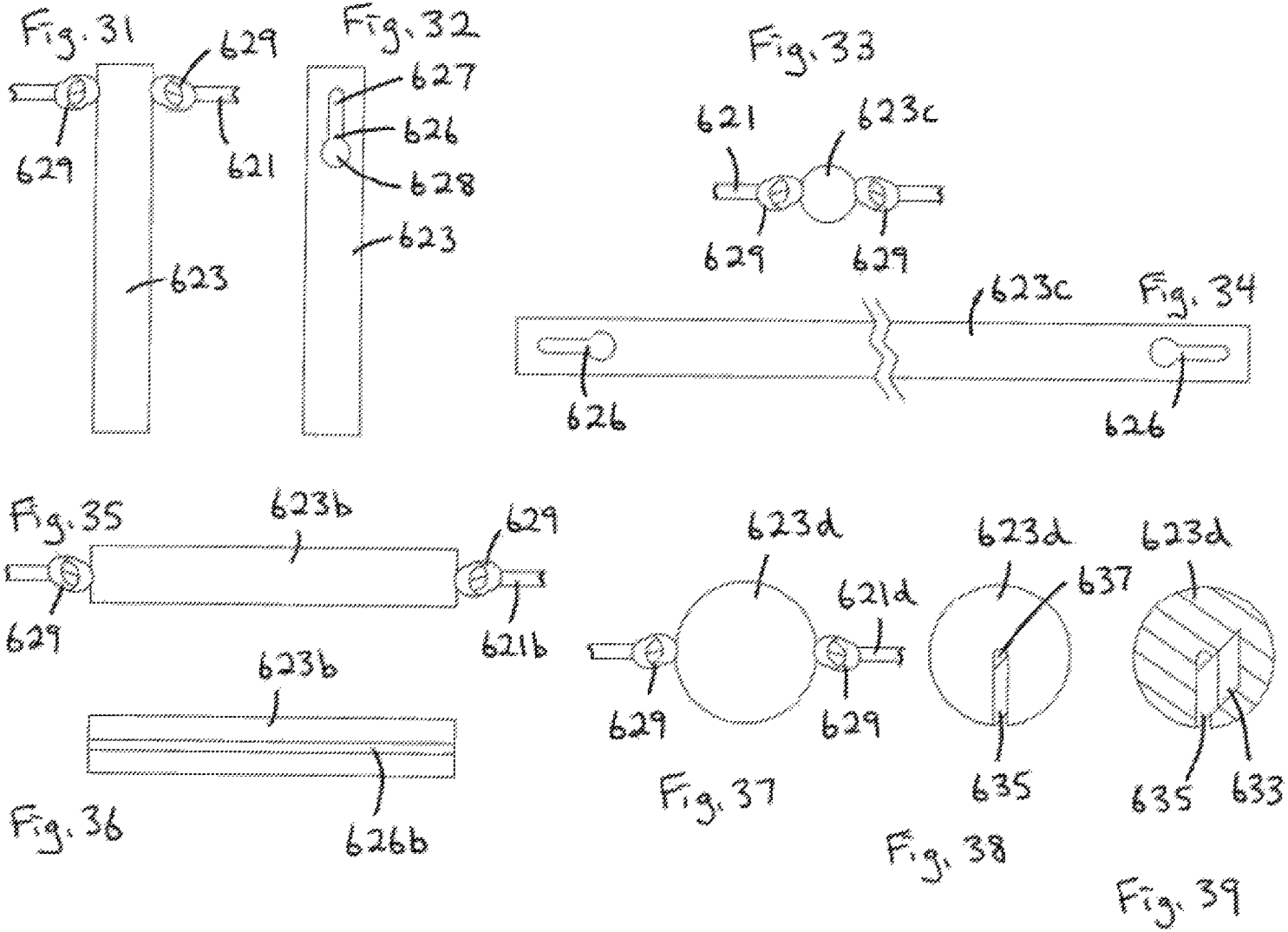
FIG. 31 is an enlarged side view of a handle mounted on the exercise apparatus of FIG. 26.
FIG. 32 is an end view of the handle of FIG. 31.
FIG. 33 is an enlarged side view of an alternative embodiment handle that may be substituted for the handle shown in FIGS. 31-32.
FIG. 34 is an end view of the handle of FIG. 33.
FIG. 35 is an enlarged side view of an alternative embodiment handle suitable for use on a modified version of the exercise apparatus of FIG. 26.
FIG. 36 is a bottom view of the handle of FIG. 35.
FIG. 37 is an enlarged side view of another alternative embodiment handle constructed according to the principles of the present invention and suitable for use on a modified version of the exercise apparatus of FIG. 26.
FIG. 38 is an end view of the handle of FIG. 37.
FIG. 39 is a sectioned end view of the handle of FIG. 37.

In relatively greater detail, FIGS. 31-32 show one of the hand grips 623 constructed according to the principles of the present invention. Each hand grip 623 and 624 is preferably a cylindrical bar or tube sized and configured to be grasped comfortably in a person's hand. The upper ends of the hand grips 623 and 624 are preferably secured to respective cords 621 and 622 by means of knots 629, causing the hand grips 623 and 624 to be suspended or hang from respective cords 621 and 622. For example, an opening 626 extends through an upper portion of the hand grip 623. The opening 626 includes a longitudinal slot 627 having an upper end that is bounded by a wall, and an opposite, lower end that opens into a circular hole 628. The diameter of the hole 628 is larger than the width of the slot 627. Both the slot 627 and the hole 628 are large enough to accommodate passage of the cord 621. However, only the hole 628 is large enough to accommodate passage of knots 629 tied in the cord 621. As a result, the hand grip 623 can be "pulled down in place" between adjacent knots 629 and selected relocated between other pairs of adjacent knots.

The right-hand grip 624 is preferably laterally aligned with the left-hand grip 623, so a person supported on the carriage 660 can conveniently grasp a desired "pair" of laterally aligned left and right hand grips 623 and 624 in his left and right hands, respectively. When the person pulls on the hand grips with sufficient force, the carriage 660 will move toward the person's hands. Conversely, when the person pushes on the hand grips with sufficient force, the carriage 660 will move away from the person's hands. In other words, the cords or flexible frame members 621 and 622 provide "push points" and "pull points" for certain exercises in a manner that may be described as effective, inexpensive, unobtrusive, and accommodating, among other things.

As suggested by FIGS. 33-34, a single, relatively longer handlebar may be substituted for a pair of hand grips 623 and 624, with a first end secured to one cord and an opposite end secured to the other cord. In this regard, a handlebar 623*c* has a left end configured for selective movement along the cord 621, and an opposite, right end configured for selective movement along the cord 622, via "mirrored" openings 626 extending through the ends of the handlebar 623*c*. The cord 621 is pulled toward the middle of the handlebar 623*c* to occupy the hole 628 and accommodate relocation of the handlebar 623*c* along the cord 621. Conversely, the cord 621 is pushed away from the middle of the handlebar 623 to occupy the closed end of the slot 627 and insert between adjacent knots 629, as shown in FIG. 33.

As suggested by FIGS. 35-36, left and right hand grips may be secured in other positions relative to the cords, including longitudinally aligned with the cords. For example, an opening 626*b* extends longitudinally through a hand grip 623*b*. The opening 626*b* includes a longitudinal slot having an outer end that extends to the perimeter of the hand grip 623*b*, and an opposite, inner end that opens into a centrally located cylindrical bore. The diameter of the bore is approximately equal to the diameter of the cord 621*b*, which in turn, is slightly greater than the width of the slot. As a result, the hand grip 623*b* can be squeezed into place between adjacent knots 629 in the cord 621*b*, and selected relocated between other pairs of adjacent knots.

In accordance with the present invention, various other sorts of hand grips, including spherical grips, for example, may be substituted for the hand grips 623 and 624. For example, FIGS. 37-39 show a spherical hand grip 623*d* constructed according to the principles of the present invention. The hand grip 623*d* includes a spherical shell 630 and a weighted latch 635 movably mounted inside the shell 630. The shell 630 is preferably injection molded plastic, and the latch 635 is preferably solid steel.

A radially oriented slot 637 extends through more than half the shell 630. An inner end of the slot 637 is bounded by an axially extending wall, and an opposite, outer end of the slot 637 defines a semi-circular interruption in the outer surface of the shell 630. The shell 630 also defines an internal compartment 633 that is angled at 45 degrees relative to the slot 637. The compartment 633 has a first end in communication with the slot 637, and an opposite, second end bounded by an internal wall. The latch 635 is slidably mounted within the compartment 633 between the position shown in FIG. 39 and a position up against the internal end wall of the compartment 633.

When the hand grip 623*d* is fitted onto the cord 621*d*, with the cord 621*d* occupying the closed end of the slot 637, gravity encourages the hand grip 623*d* to orient with the relatively denser latch 635 toward the ground, and also encourages the latch 635 to slide "down" across the slot 637. In other words, when the hand grip 623*d* is oriented as shown in FIGS. 38-39, the latch 635 closes off the slot 637 and captures the cord 621*d* inside the slot 637, with the handgrip 623*d* disposed between adjacent knots 629.

Persons skilled with the art will also recognize that any or all of the foregoing hand grip configurations may be secured in place using other known means, including known rope clamping devices that would allow selective adjustment of the hand grips along respective cords without any knots in the cords, for example.

Figure 40:
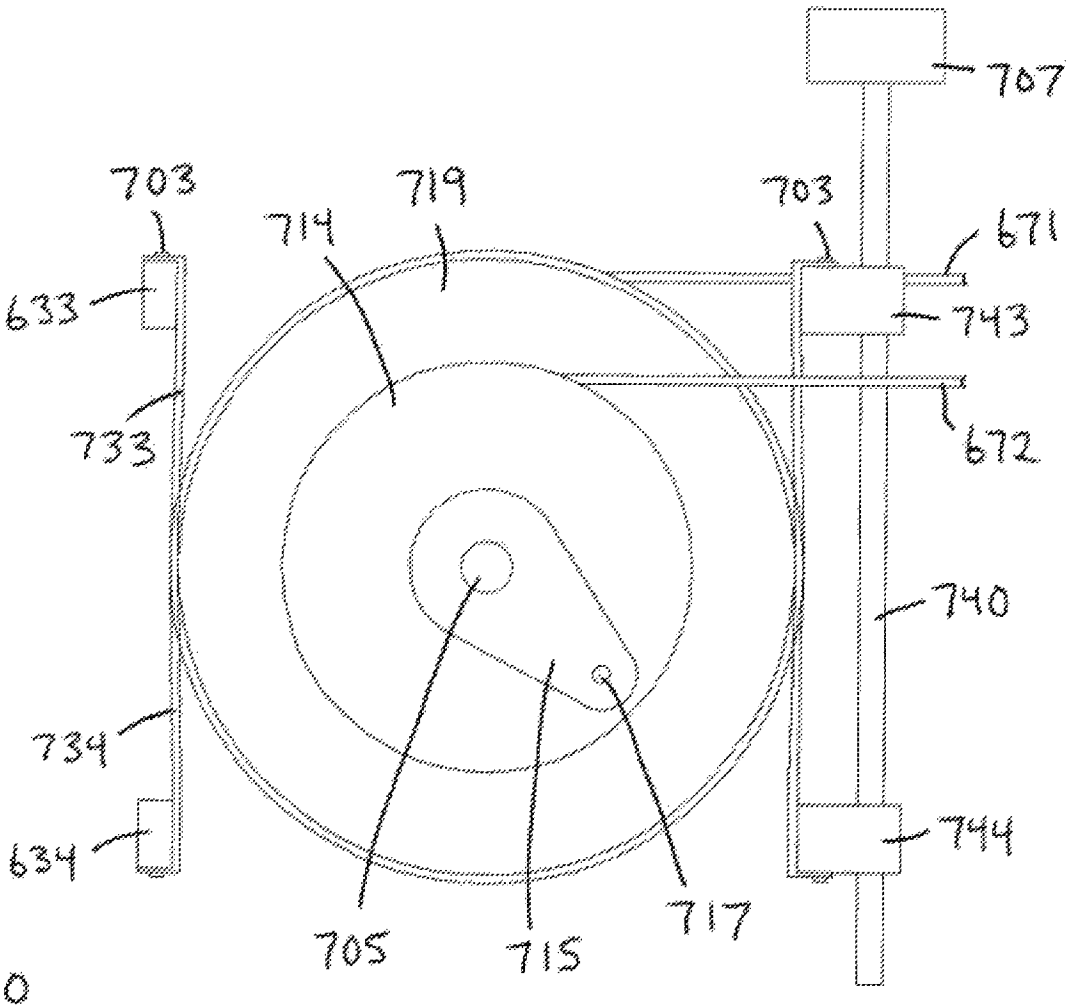
FIG. 40 is an enlarged side view of resistance assembly components on the exercise apparatus of FIG. 26.

FIG. 40 shows an enlarged image of components of the resistance assembly 700, which may be described as a scaled-up version of the resistance assembly inside one of the modular units 100*b*, but with the addition of a second cord 672, as noted above with reference to the platform 660. In this regard, the resistance assembly 700 includes a brake drum 719 keyed to the shaft 705 to rotate together with the shaft 705. The brake drum 719 has a diameter of nine inches and a depth of two and one-eighth inches. The brake drum 719 includes a dual passage slot to receive the two ends of a Kevlar strap (not shown). The anchored end of the strap is secured within the leading passage, and the loose end of the strap is slideable within the trailing passage, with an intermediate portion disposed therebetween and wrapped about the brake drum 719.

First and second brake bands 733 and 734 are wrapped around respective first and second sides of the brake drum 719 and sandwich the Kevlar strap disposed therebetween. The brake bands 733 and 734 are configured with slotted portions and narrowed width portions to bypass one another (at 3:00 and 9:00 in FIG. 40). A first end of each brake band 733 and 734 is fastened to a respective support 633 or 634 on the frame member 607. An opposite, second end of each brake band 733 and 734 is fastened to a respective adjustment nut 743 or 744. In this regard, each end of each brake band 733 and 734 is preformed to bend 90 degrees around the corner of a respective support 633 or 634 or adjustment nut 743 or 744, and then fastened thereto by two screws 707 extending parallel to adjustment bolt 740.

The adjustment bolt 740 is rotatably mounted on an elongated U-shaped bracket 637 (see FIG. 26), which in turn, is rigidly mounted on the frame 110. A knob 707 is affixed to an upper end of the adjustment bolt 740 to accommodate adjustments to resistance by a person sitting on the platform 660. In this regard, the upper adjustment nut 743 is threaded onto right hand threads on the upper half of the adjustment bolt 740, and the lower adjustment nut 744 is threaded onto left hand threads on the lower half of the adjustment bolt 740, so when the knob 707 is rotated a first direction, the adjustment nuts 743 and 744 move away from one another, and when the knob 707 is rotated an opposite, second direction, the adjustment nuts 743 and 744 move toward one another.

To the near side of the brake drum 719 in FIGS. 26 and 40, a relatively smaller diameter sheave 712 is mounted on the shaft 705 via a one-way clutch roller bearing (not shown). The diameter of the sheave 712 is six inches, and the thickness is one and one-half inches. At least one spacer (not shown) is mounted on the shaft 705 between the sheave 712 and the brake drum 719 to maintain proper spacing along the shaft 705 and relative to the bracket 662 on the platform 660. An end of the cord 672 is secured inside the sheave 712, and a proximate portion of the cord 672 is wound about the sheave 712.

A spring housing 714 is rigidly secured to an outboard wall of the sheave 712 to define an enclosed spring compartment. The spring housing 714 contains a re-wind spring (not shown), and an outer end of the re-wind spring is secured to a peripheral portion of the spring housing 714. An opposite, inner end of the re-wind spring is secured to an inboard portion of a spring bushing 715. The spring bushing 715 fits loosely about the shaft 705, and the outboard portion of the spring bushing 715 is secured to the frame member 615 via a pin 716 (see FIG. 27) inserted through a hole 717 in the spring bushing 715. At least one spacer (not shown) is mounted on the shaft 705 between the spring bushing 715 and the bearing mount 605 to maintain proper spacing along the shaft 705 and relative to the bracket 662 on the platform 660.

With reference to FIG. 26 (and assuming a more rearward start position for the platform 660), when the platform 660 moves toward the resistance assembly 700, pulling force transmitted through the cord 672 causes the sheave 712 and the brake drum 719 to rotate in a clockwise direction. When the platform 660 reverses directions and moves away from the resistance assembly 700, pulling force exerted by the re-wind spring on the sheave 712 causes the sheave 712 to rotate in the counter-clockwise direction (relative to the brake drum 719 and the shaft 705).

Except for the relatively larger sheave 711, a mirrored assembly of components is disposed on the far side of the brake drum 719 (in FIG. 40). In this regard, the larger diameter sheave 711 is mounted on the shaft 705 via a one-way clutch roller bearing (not shown). The diameter of the sheave 711 is nine inches, and the thickness is one and one-half inches. At least one spacer (not shown) is mounted on the shaft 705 between the sheave 711 and the brake drum 719 to maintain proper spacing along the shaft 705 and relative to the bracket 661 on the platform 660. An end of the cord 671 is secured inside the sheave 711, and a proximate portion of the cord 671 is wound about the sheave 711.

A spring housing 713 is rigidly secured to an outboard wall of the sheave 711 to define a spring compartment. The spring housing 713 contains a re-wind spring (not shown), and an outer end of the re-wind spring is secured to a peripheral portion of the spring housing 711. An opposite, inner end of the re-wind spring is secured to an inboard portion of a spring bushing 715. The spring bushing 715 fits loosely about the shaft 705, and the outboard portion of the spring bushing 715 is similarly secured to the far frame member 615 via a pin 716 inserted through a hole in the spring bushing 715. At least one spacer (not shown) is mounted on the shaft 705 between the spring bushing 715 and the far bearing mount 605 to maintain proper spacing along the shaft 705 and relative to the bracket 661 on the platform 660.

With reference to FIG. 26, when the platform 660 moves away from the resistance assembly 700, pulling force transmitted through the cord 671 causes the sheave 711 and the brake drum 719 to rotate in a clockwise direction. When the platform 660 reverses directions and moves toward the resistance assembly 700, pulling force exerted by the re-wind spring on the sheave 711 causes the sheave 711 to rotate in the counter-clockwise direction (relative to the brake drum 719 and the shaft 705). As a result, a person can perform sequential repetitions of a leg press exercise subject to primarily positive resistance followed by a leg curl exercise subject to primarily positive resistance.

Figure 42:
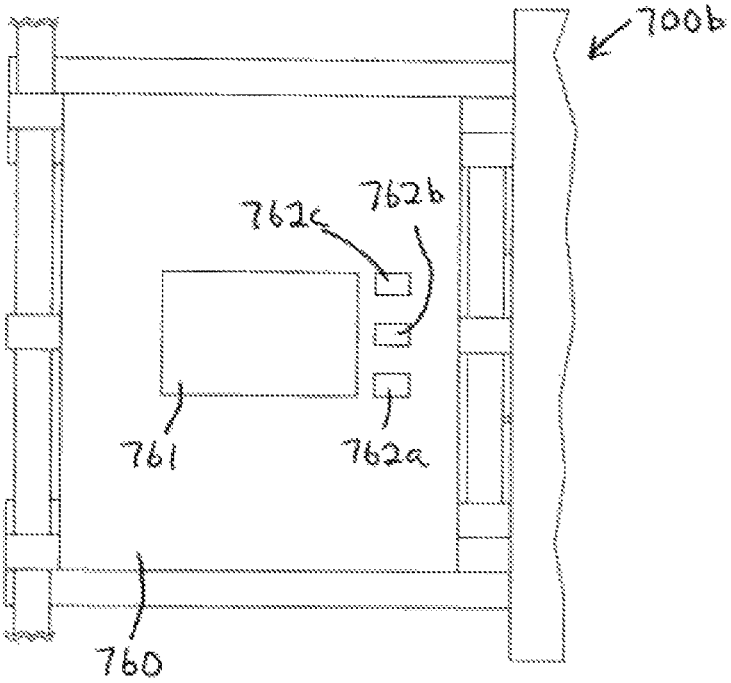
FIG. 42 is a top view of a shroud overlying the resistance assembly of FIG. 41.
Figure 41:
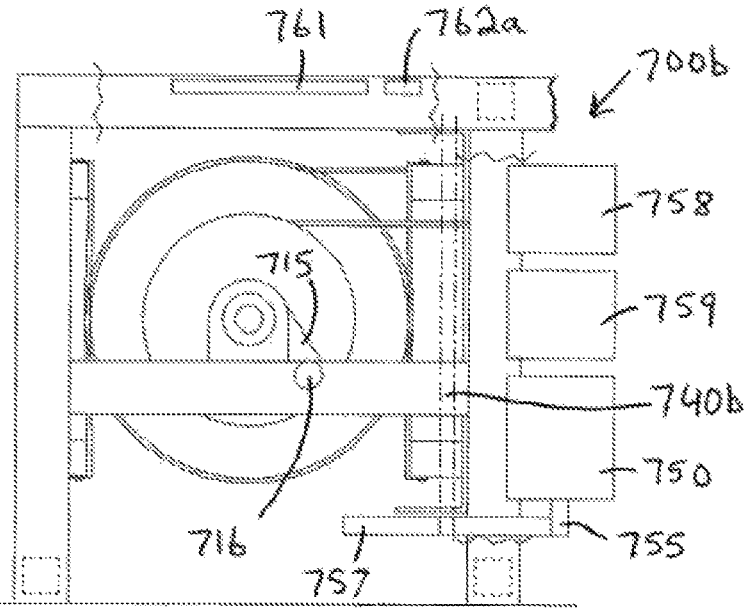
FIG. 41 is a side view of an alternative embodiment resistance assembly that may be substituted for the resistance assembly shown in FIG. 40.

FIGS. 41-42 show an alternative arrangement 700*b* for adjusting tension in the brake bands 733 and 734. The adjustment bolt 740*b* is similar to the adjustment bolt 740, except that the knob 707 has been removed from the upper end of the adjustment bolt 740*b*, and a relatively large diameter gear 757 has been keyed to an opposite, lower end of the adjustment bolt 740*b*. Compatible gear teeth link the gear 757 to the shaft 755 of a conventional stepper motor 750, which is mounted on the base 611. A control unit 758 is mounted on the base 611 and operatively connected to the stepper motor 750 to send signals to the stepper motor 750. A conventional power supply 759 is mounted on the base 611 to provide power to the control unit 758 and the motor 750.

In response to a first control signal, the shaft 755 rotates in a first direction, causing the adjustment nuts 743 and 744 to move away from one another. In response to a second control signal, the shaft 755 rotates in an opposite, second direction, causing the adjustment nuts 743 and 744 to move toward one another. The control signals may be generated based on previously recorded data for a particular exercise routine and/or may be generated in real time based on a desire to change a resistance setting during exercise.

A cover plate or shroud 760 is mounted on the base 611, between the rails 616 and the posts 612 and 614, to overlie the resistance assembly 700*b*. The shroud 760 is configured to accommodate and support two user input devices 761 and 762*a-c*, which may be used separately and/or collectively.

The device 761 is an otherwise conventional cell phone provided with an app that is compatible and in communication with the control unit 758. The app generates user screens on the cell phone 761, including a start-up screen which allows a user to register, sign in as someone already registered, or start without registering or signing in. The app then offers the user options for exercise routines, including an option that simply involves adjusting resistance by pushing a "+" button or a "–" button. If a registered user selects a previously used routine, the app will automatically adjust resistance to predetermined levels based on stored data from the previous workout. If a new routine is selected, the app will automatically adjust resistance to "best guess" levels based on data known about the user. In any event, the user can adjust the resist manually at any time and/or signal when a desired level of resistance should be saved in connection with a particular exercise.

The devices 762*a-c* are part of an input panel, including at least the three buttons 762*a*-762*c*, that is wired to the control unit 758. The button 762*a* is a power button that toggles up to turn on the adjustment mechanism and down to turn off the adjustment mechanism. The button 762*b* is an adjustment button that toggles up to increase current resistance to exercise and down to decrease current resistance to exercise. The button 762*c* is a menu button that offers options to the user and cooperates with the adjustment button 762*b* to select options and input data. The control unit 758 includes memory for purposes of storing information from one use to the next. Also, a port (not shown), such as a USB port, is preferably connected to the device to receive a removable memory device, such as a flash drive, for purposes of storing data in a portable format.

Figure 43:
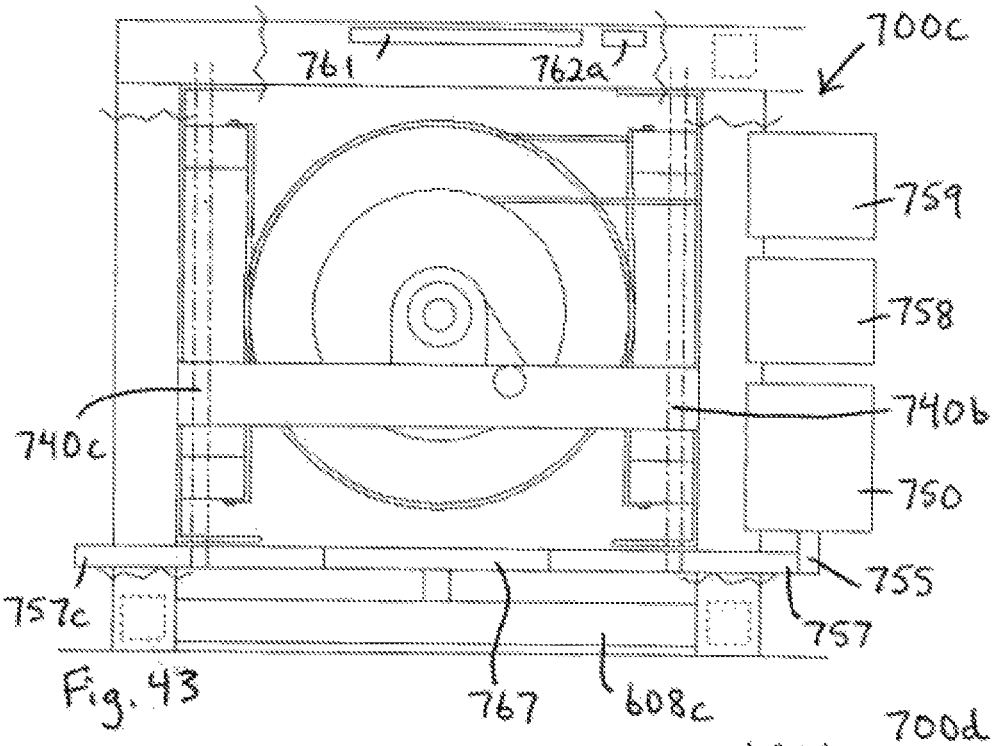
FIG. 43 is a side view of another alternative embodiment resistance assembly that may be substituted for the resistance assembly shown in FIG. 41.

FIG. 43 shows an alternative adjustment assembly 700*c* that is similar in many respects to the resistance adjustment assembly 700*b* shown in FIGS. 41-42. On this assembly 700*c*, the stationary brake band supports have been replaced with a second adjustment bolt assembly, including an adjustment bolt 740*c*, adjustment nuts 743 and 744 threaded onto respective ends of the adjustment bolt 740*c*, and a gear 757*c* secured to the lower end of the adjustment bolt 740*c*. An additional frame member 608*c* is mounted on the base 611 to rotatably support an idler gear 767 operatively interconnected between the two adjustment bolt gears 757 and 757*c*. As a result of this arrangement, adjustment time is cut in half for a given rotational speed of the stepper motor shaft 755.

Figure 44:
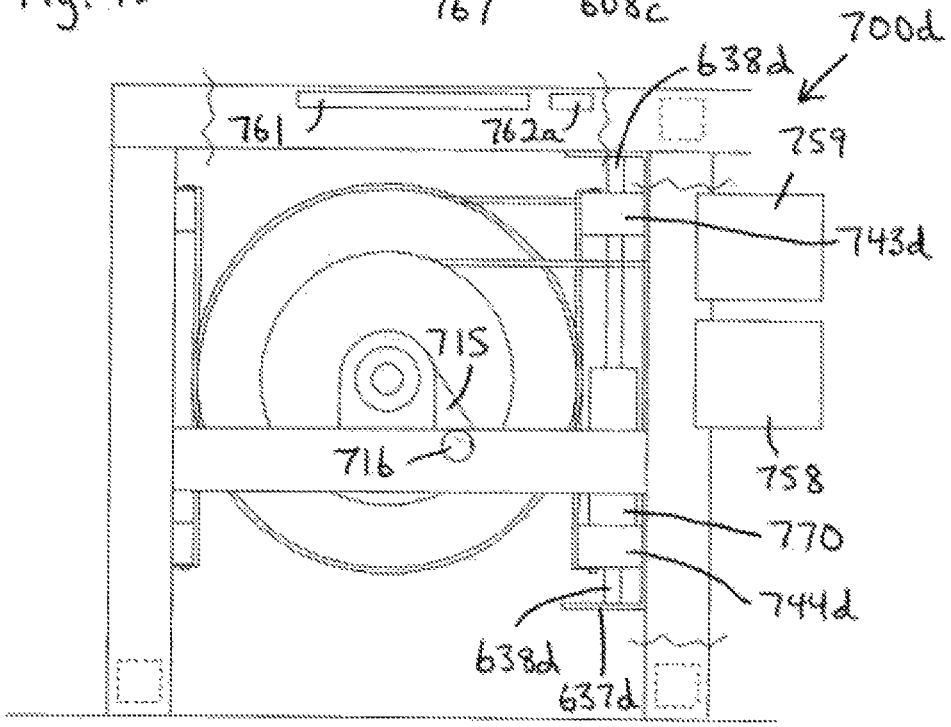
FIG. 44 is a side view of yet another alternative embodiment resistance assembly that may be substituted for the resistance assembly shown in FIG. 41.

FIG. 44 shows another alternative adjustment assembly 700*d* that is similar in certain respects to the resistance adjustment assembly 700 shown in FIGS. 25-27 and 40. On this assembly 700*d*, the adjustment bolt has been replaced by a linear actuator 770 having a rod end connected to the upper adjustment nut 743*d*, and a cylinder end connected to the lower adjustment nut 744*d*. Frame members 638*d* have been added to the support bracket 637*d* to maintain the adjustment nuts 743*d* and 744*d* and the linear actuator 770 in the depicted orientation relative to the frame 610. In this arrangement, the linear actuator 770 and the adjustment nuts 743*d* and 744*d* "float" or self-locate along the prescribed orientation.

The subject invention may also be described in terms of various methods with reference to one or more of the foregoing embodiments. For example, a method is provided for connecting a modular exercise resistance device to a bracket. One such method involves arranging the resistance device at an insertion angle relative to the bracket with an upper end of the resistance device tilted toward an upper end of the bracket; inserting the upper end of the resistance device into engagement with the upper end of the bracket; sliding an opposite, lower end of the resistance device between movable guides on the bracket in such a manner that the guides deflect downward and the resistance device is less tilted relative to the bracket; and continuing the sliding step until the lower end of the resistance device clears the guides, and the guides deflect upward to latch the resistance device in place. Various additional and/or alternative steps may be described with reference to the foregoing embodiment and obvious variations thereof.

The subject invention has been described with reference to a preferred embodiment and a particular application with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of allowable claims that issue from this application or any related application.

Ways of describing the present invention include:

A1. An exercise apparatus, comprising:

a frame;

a shaft rotatably mounted on the frame;

a sheave mounted to the shaft for rotation in a first direction together with the shaft and rotation in an opposite, second direction relative to the shaft;

a spiral rewind spring having a first end and an opposite, second end, wherein the first end is fastened to the sheave;

a connector rotatably mounted on the shaft, wherein the connector is operatively interconnected in series between the frame and the second end of the rewind spring; and a cord operatively interconnected in series between the sheave and a force receiving member, wherein the sheave rotates with the shaft in the first direction in response to a user exerting force against the force receiving member, and the sheave rotates relative to the shaft in the second direction in response to the rewind spring exerting force against the sheave.

A2. The exercise apparatus of claim A1, wherein the connector is nested inside coils of the rewind spring.

A3. The exercise apparatus of claim A2, wherein the connector defines a round perimeter, and the rewind spring coils about the round perimeter.

A4. The exercise apparatus of claim A3, wherein the second end of the spring is disposed inside the perimeter.

A5. The exercise apparatus of claim A4, wherein the perimeter is a cylinder centered about an axis disposed a distance apart from an axis of rotation defined by the shaft.

A6. The exercise apparatus of claim A2, further comprising a housing disposed about the rewind spring, wherein a first portion of the connector is disposed inside the housing, and a second portion of the connector is disposed outside the housing.

A7. The exercise apparatus of claim A6, wherein the connector is sized and configured to key into multiple different orientations relative to the housing.

A8. The exercise apparatus of claim A6, wherein the connector defines a round perimeter, and the rewind spring coils about the round perimeter, and the second end of the spring is disposed inside the perimeter.

A9. The exercise apparatus of claim A1, wherein the connector is selectively rotatable relative to the frame to adjust how much rewind force is exerted by the spring.

A10. The exercise apparatus of claim A1, wherein the connector defines a round perimeter, and the rewind spring coils about the round perimeter, and the second end of the spring is disposed inside the perimeter.

B1. An exercise apparatus, comprising:

a frame;

a shaft rotatably mounted on the frame;

a first rotating member operatively connected to the shaft for rotation with the shaft in a first direction and relative to the shaft in an opposite, second direction;

a second rotating member rigidly connected to the shaft for rotation with the shaft in each said direction, wherein one said rotating member is a brake device, and the other said rotating member is a sheave;

a coiled rewind spring having an inner end and an opposite, outer end, wherein the outer end is fastened to the sheave;

a spring bushing rotatably mounted on the shaft, wherein at least part of the spring bushing is nested inside coils of the rewind spring, and the spring bushing is operatively interconnected in series between the frame and the inner end of the rewind spring, and the spring bushing defines a round perimeter, and the inner end of the rewind spring is disposed inside the perimeter; and a cord operatively interconnected in series between the sheave and a force receiving member, wherein the sheave rotates with the brake device in the first direction in response to a user exerting force against the force receiving member, and the sheave rotates relative to the brake device in the second direction in response to the rewind spring exerting force against the sheave.

B2. The exercise apparatus of claim B1, wherein the perimeter is a cylinder centered about an axis disposed a distance apart from an axis of rotation defined by the shaft.

B3. The exercise apparatus of claim B1, further comprising a housing disposed about the rewind spring, wherein a first portion of the connector is disposed inside the housing, and a second portion of the connector is disposed outside the housing.

B4. The exercise apparatus of claim B3, wherein the connector is sized and configured to key into multiple different orientations relative to the housing.

B5. The exercise apparatus of claim B1, wherein the connector is selectively rotatable relative to the frame to adjust how much rewind force is exerted by the spring.

C1. A method of displaying a current percentile resistance setting on an exercise apparatus as a percentile of a maximum resistance setting, comprising the steps of:

providing an exercise apparatus having a cord that is pulled from a sheave by a user subject to a selectively adjustable level of frictional resistance;

establishing at least one baseline percentile resistance setting based on the cord being pulled from the sheave under predetermined circumstances;

monitoring subsequent adjustments made to the level of resistance by the user; and displaying a current percentile resistance setting based on said at least one baseline percentile resistance setting and any said adjustments made by the user.

C2. The method of claim C1, wherein the establishing step involves establishing a first baseline percentile resistance setting based on the cord being pulled from the sheave subject to minimum amount of resistance.

C3. The method of claim C2, wherein the establishing step involves establishing a first baseline percentile resistance setting based on the cord being pulled from the sheave subject to maximum amount of resistance.

C4. The method of claim C1, wherein the establishing step involves establishing a first baseline percentile resistance setting based on the cord being pulled from the sheave subject to prescribed amount of resistance.

C5. The method of claim C1, wherein the monitoring and displaying steps involve updating a memory location each time resistance is adjusted, and displaying the current percentile resistance setting based on the data currently stored in said memory location.

C6. The method of claim C5, further comprising the steps of saving previous data stored in said memory location, saving additional data associated with any previous recalibrations of the data stored in said memory location, and using said data to update steps taking to compute the current percentile resistance setting.

C7. The method of C1, further comprising the steps of:

providing a second said exercise apparatus; and after having connecting one said cord to the other said cord, pulling one said exercise apparatus apart from the other said exercise apparatus under predetermined conditions to synchronize current percentile resistance setting displayed on the one said exercise apparatus with the current percentile resistance setting displayed on the other said exercise apparatus.

D1. An exercise apparatus, comprising:

a base configured to define a generally horizontal foot platform relative to an underlying floor surface;

a tube mounted on the foot platform to extend perpendicularly upward from the foot platform;

a support bracket sleeved over the tube;

a resistance module connected to the support bracket, wherein the resistance module includes a cord that is extractable for exercise purposes; and a handle bar inserted into the tube to define a handgrip at an elevation above the foot platform and the resistance module.

D2. The exercise apparatus of claim D1, wherein the support bracket has a first side and an opposite, second side, and the resistance module is supported on the first side, and the second side defines a bulbous shape sized and configured to be grasped comfortably in a person's hand when a person is lying supine on the floor surface with his knees bent and his feet on the foot platform.

D3. The exercise apparatus of claim D1, wherein the handle bar includes a first segment that extends parallel to the tube, and a second segment that extends perpendicular to the first segment at said elevation when the first segment is inserted into the tube.

D4. The exercise apparatus of claim D3, wherein the handle bar includes a third segment that extends perpendicular to both the first segment and the second segment, and defines an alternative handgrip at a discrete elevation above the foot platform and the resistance module when the first segment is inserted into the tube.

D5. The exercise apparatus of claim D4, wherein the handlebar is selectively rotatable relative to the tube to alternatively position the second segment or the third segment directly above the foot platform.

D6. The exercise apparatus of claim D5, wherein a bolt extends transversely through the tube and the support bracket, and a first pair of diametrically opposed slits extends through a lower end of the first segment to align with and receive the bolt when the second segment is directly above the foot platform, and a second pair of diametrically opposed slits extends through the lower end of the first segment to align with and receive the bolt when the third segment is directly above the foot platform.

D7. The exercise apparatus of claim D1, wherein the handle bar is selectively slidable into the tube to accommodate a first exercise activity, and selectively slidable out of the tube to accommodate a second exercise activity.

D8. The exercise apparatus of claim D1, wherein the support bracket includes a latch that resiliently deflects to accommodate insertion of the resistance module into the support bracket, and alternatively, removal of the resistance module from the support bracket.

D9. The exercise apparatus of claim D8, wherein the resistance module includes an exterior shell, and first and second notches are defined in the shell, and the first and second notches are bounded by respective first walls that face away from one another and by respective second walls that face away from the support bracket, and the latch bears against the first walls both during insertion and removal of the resistance module and when the resistance module is fully inserted into the support bracket, and the latch resiliently deflects into place against the second walls only when the resistance module is fully inserted into the support bracket.

D10. The exercise apparatus of claim D9, wherein a third notch is defined in the shell at a location along a line that extends perpendicularly through a midpoint of a line segment extending between the first and second notches, and a distance measured linearly between said location and said midpoint is greater in length than said line segment, and the third notch is bounded by opposing walls that face toward one another and by an additional wall that faces away from the support bracket, and the support bracket includes a hook that bears against the opposing walls and the additional wall when the resistance module is inserted into the support bracket.

E1. An exercise apparatus, comprising:

a base configured to define a generally horizontal foot platform relative to an underlying floor surface;

a left support and a right support, wherein each said support is mounted on a respective side of the foot platform to extend perpendicularly upward from the foot platform; and a left handle bar and a right handle bar, wherein each said handle bar is connected to a respective said support to define a respective first horizontal handgrip at a first elevation above the foot platform, and a respective second horizontal handgrip at a relatively lower, second elevation above the foot platform, wherein each said first horizontal handgrip extends perpendicular to a respective said second horizontal handgrip.

E2. The exercise apparatus of claim E1, wherein each said handle bar includes a lowermost segment that extends perpendicular to the foot platform, and each said lowermost segment is releasably connected to a respective said support.

E3. The exercise apparatus of claim E2, wherein each said handlebar is selectively rotatable relative to a respective said support to alternatively position a respective said second segment or a respective said third segment directly above the foot platform E4. The exercise apparatus of claim E3, wherein a separate bolt extends transversely through each said support, and a first pair of diametrically opposed slits extends through each said lowermost segment to align with and receive the bolt when the first handgrip is directly above the foot platform, and a second pair of diametrically opposed slits extends through each said lowermost segment to align with and receive the bolt when the second handgrip is directly above the foot platform.

E5. The exercise apparatus of claim E1, wherein each said support is a tube, and each said handlebar is selectively slidable into a respective said tube to accommodate a first exercise activity, and selectively slidable out of a respective said tube to accommodate a second exercise activity.

F1. An exercise apparatus, comprising:

a base, wherein the base is configured to define a generally horizontal foot platform relative to an underlying floor surface, and the foot platform has a perimeter;

a support bracket pivotally mounted on the base for pivoting about a vertical axis relative to the foot platform;

a resistance module connected to the support bracket, wherein the resistance module includes a cord that is extractable for exercise purposes, and the support bracket selectively pivots between a first position, positioning the resistance module inside the perimeter, and a second position, positioning the resistance module outside the perimeter.

F2. The exercise apparatus of claim F1, wherein a latching member is releasably inserted through aligned openings in the base and the support bracket to latch the support bracket in either said position relative to the base.

F3. The exercise apparatus of claim F2, wherein the base includes a steel tube, and the support bracket is pivotally mounted on the steel tube, and the latching member includes a leaf spring disposed inside the steel tube.

F4. The exercise apparatus of claim F3, wherein the leaf spring is integrally connected to a cap covers exposed edges at one end of the steel tube.

F5. The exercise apparatus of claim F4, wherein a bolt supporting structure is integrally connected to the leaf spring, and the support bracket is pivotally mounted on the steel tube by a bolt extending through the support bracket, an upper wall of the steel tube, and the bolt supporting structure.

F6. The exercise apparatus of claim F5, wherein said openings in the support bracket include first and second opening disposed equal distance from the bolt.

G1. An exercise apparatus, comprising:

a resistance module, wherein the resistance module includes a shell, a sheave rotatably mounted inside the shell, and a cord selectively interconnected in series between the sheave and a force receiving member, wherein the shell defines first and second notches bounded by respective first and second sidewalls that face away from one another; and a support bracket, wherein the support bracket includes a latch that resiliently deflects to accommodate insertion of the resistance module into the support bracket and removal of the resistance module from the bracket, wherein the support bracket defines first and second beams that align with respective said notches and slidably engage respective said sidewalls during insertion and removal and retention of the resistance module relative to the support bracket.

G2. The exercise apparatus of claim G1, wherein first and second portions of the latch align with respective said beams and similarly align with respective said notches to slidably engage respective said sidewalls during insertion and removal and retention of the resistance module relative to the support bracket.

G3. The exercise apparatus of claim G2, wherein the first and second portions of the latch occupy inwardly opening notches in respective said beams.

G4. The exercise apparatus of claim G3, wherein the shell defines a third notch diametrically opposed from a midpoint between the first and second notches, and the support bracket includes a member sized and configured to occupy the third notch during retention of the resistance module relative to the support bracket.

H1. An exercise apparatus, comprising:

a frame;

a sheave rotatably mounted on the frame, wherein the sheave includes a groove disposed between opposing sidewalls, and the groove has a width measured perpendicularly between the sidewalls;

a re-directional bearing movably mounted on the frame, wherein the re-directional bearing includes an inner pair of guides disposed a first distance apart from one another and an outer pair of guides disposed a second distance apart from one another, wherein the first distance is less than the width, and the second distance is greater than the width;

a cord operatively interconnected in series between the sheave and a force receiving member, wherein an intermediate portion of the cord extends through the re-directional bearing, including each pair of guides, and the sheave rotates in an operational direction in response to a user exerting force against the force receiving member.

H2. The exercise apparatus of claim H1, wherein the re-directional bearing rotates about an axis, and each said distance is measured perpendicular to the axis.

H3. The exercise apparatus of claim H1, wherein the guides are roller pins.

I1. An exercise apparatus, comprising:

a frame;

a sheave rotatably mounted on the frame, wherein the sheave includes a groove disposed between opposing sidewalls, and the groove has a width measured perpendicularly between the sidewalls;

a re-directional bearing movably mounted on the frame for rotation about an axis, wherein the re-directional bearing includes a pair of diametrically opposed first and second guides disposed equal distance from the axis and defining a diametrically measured distance therebetween, wherein the distance is greater than the width; and a cord operatively interconnected in series between the sheave and a force receiving member, wherein an intermediate portion of the cord extends through the re-directional bearing, including the guides, and the sheave rotates in an operational direction in response to a user extracting the cord via the force receiving member.

I2. The exercise apparatus of claim I1, wherein the re-directional bearing includes a relatively more internal pair of diametrically opposed first and second guides disposed equal distance from the axis and defining a second diametrically measured distance therebetween, wherein the second distance is less than the width.

I3. The exercise apparatus of I1, wherein the re-directional bearing defines first and second cord guiding surfaces that extend perpendicular to said guides and define a second diametrically measured distance therebetween, wherein the second distance is less than the width.

J1. An exercise apparatus, comprising:

a rigid frame;

a body supporting platform movable on the frame;

a flexible member having a first portion connected to a first location on the frame, a second portion connected to a section location on the frame, and a third portion extending therebetween; and a handle mounted on the third portion in such a manner that a person on the body supporting platform can pull against the handle to move the body supporting platform in a first direction relative to the frame, and push against the handle to move the body supporting platform in an opposite, second direction relative to the frame.

J2. The exercise apparatus of claim J1, further comprising a sheave rotatably mounted on the frame; and a cord operatively interconnected in series between the sheave and the body supporting platform to rotate the sheave relative to the frame in response to movement of the body supporting platform in at least one said direction relative to the frame.

J3. The exercise apparatus of claim J1, wherein the handle extends perpendicular to the third portion.

J4. The exercise apparatus of claim J1, wherein the handle is longitudinally aligned with the third portion.

J5. The exercise apparatus of claim J1, wherein the handle is a sphere.

J6. The exercise apparatus of claim J1, further comprising a second said flexible member extending parallel to the first said flexible member; and a second said handle mounted thereon.

J7. The exercise apparatus of claim J1, further comprising a second said flexible member extending parallel to the first said flexible member, wherein the handle is interconnected between therebetween and extends perpendicular relative thereto.

J8. The exercise apparatus of claim J1, wherein the handle defines a slot sized and configure to receive a segment of the flexible member, a weighted latch is movably mounted inside the handle, and gravity encourages the latch to cover the slot with the segment of the flexible member retained inside.

K1. An exercise apparatus, comprising:

a frame having a foot end and an opposite, head end;

a body supporting platform movably mounted on the frame for movement between the foot end and the head end;

at least one resistance device interconnected between the frame and the body supporting platform to resist movement of the body supporting platform relative to the frame; and a foot platform pivotally mounted on the foot end, wherein the foot platform extends from a toe end to a heel end, and when a user pushes against the foot platform with his feet to move the body supporting platform away from the foot end, the foot platform remains in a predetermined orientation, relatively more perpendicular than parallel relative to the body supporting platform and with the toe end at a higher elevation than the heel end, and when a user pulls against the foot platform with his feet to move the body supporting platform toward the foot end, the foot platform is free to pivot toward a temporary orientation, relatively more parallel than perpendicular relative to the body supporting platform and with the toe end relatively closer to the foot end.

K2. The exercise apparatus of claim K1, further comprising a strap cooperating with the foot platform to formed a closed loop about a person's foot.

K3. The exercise apparatus of claim K1, wherein the at least one resistance device includes a first sheave rotatably mounted on the frame and operatively connected to the platform in a manner that resists movement of the platform in a first direction relative to the frame.

K4. The exercise apparatus of claim K3, wherein the at least one resistance device further includes a second sheave rotatably mounted on the frame and operatively connected to the platform in a manner that resists movement of the platform in an opposite, second direction relative to the frame.

K5. The exercise apparatus of claim K4, wherein each said sheave is operatively connected to a common brake drum rotatably mounted on the frame proximate a first end of the frame, and a first cord is interconnected between the sheave and the platform, and a second cord is interconnected between the sheave and the platform, and only the second said cord is routed about a pulley at an opposite, second end of the frame.

L1. An exercise apparatus, comprising:

a frame configured to occupy a stable position on an underlying floor surface, wherein the frame has a first end, a second end, a left side and a right side;

a shaft having a left end rotatably mounted on the left side of the frame proximate the first end, and a right end rotatably mounted on the right side of the frame proximate the first end;

at least one sheave operatively mounted on the shaft;

at least one brake drum operatively mounted on the shaft, wherein the brake drum and the sheave are constrained to rotate together in a first direction, and one is free to rotate relative to the other in an opposite, second direction;

a force receiving member movably mounted on the frame;

at least one cord operatively interconnected between the force receiving member and the sheave at least one pulley rotatably mounted on the frame, wherein an intermediate portion of the cord is routed through said at least one pulley; and a foot platform having a first side connected to the left side of the frame, and an opposite, second side connected to the right side of the frame.

L2. The exercise apparatus of claim L1, further comprising a body supporting carriage movable mounted on the frame for movement along a path between the first end and the second end.

M1. An exercise apparatus, comprising:

a frame configured to occupy a stable position on an underlying floor surface, wherein the frame has a first end and an opposite, second end;

a pulley rotatably mounted on the frame proximate the first end;

a shaft rotatably mounted on the frame proximate the second end;

a brake drum rigidly secured to the shaft for rotation together with the shaft;

a first sheave operatively mounted on the shaft to rotate the shaft in a braking direction and to rotate relative to the shaft in an opposite, rewind direction;

a second sheave operatively mounted on the shaft to rotate the shaft in the braking direction and to rotate relative to the shaft in the rewind direction;

a force receiving member movably mounted on the frame;

a first cord operatively interconnected between the force receiving member and the first sheave, wherein the first cord extends in a first direction away from the force receiving member and toward the first end; and a second cord operatively interconnected between the force receiving member and the second sheave, wherein the second cord extends in an opposite, second direction away from the force receiving member and is routed about the pulley, whereby the second sheave rotates in the braking direction in response to movement of the force receiving member in the first direction, and the first sheave rotates in the braking direction in response to movement of the force receiving member in the second direction.

M2. The exercise apparatus of claim M1, wherein one said sheave has a relatively larger, first diameter, and the other said sheave has a relatively smaller, second diameter.

M3. The exercise apparatus of claim M1, further comprising means for establishing a first magnitude of user imposed force sufficient to move the force receiving member in the first direction and a discrete, second magnitude of user imposed force sufficient to move the force receiving member in the second direction.

N1. An exercise apparatus, comprising:

a frame configured to occupy a stable position on an underlying floor surface, wherein the frame has a first end and an opposite, second end;

a first resistance module mounted on the frame proximate the first end;

a second resistance module mounted on the frame proximate the second end, wherein each said resistance module includes (a) a brake drum; (b) a sheave; and (c) a cord;

a force receiving member interconnected in series between the cord of the first resistance module and the cord of the second resistance module;

a brake drum rigidly secured to the shaft for rotation together with the shaft;

a first sheave operatively mounted on the shaft to rotate the shaft in a braking direction and to rotate relative to the shaft in an opposite, rewind direction;

a second sheave operatively mounted on the shaft to rotate the shaft in the braking direction and to rotate relative to the shaft in the rewind direction;

a force receiving member movable on the frame;

a first cord operatively interconnected between the force receiving member and the first sheave, wherein the first cord extends in a first direction away from the force receiving member and toward the first end; and a second cord operatively interconnected between the force receiving member and the second sheave, wherein the second cord extends in an opposite, second direction away from the force receiving member and is routed about the pulley, whereby the second sheave rotates in the braking direction in response to movement of the force receiving member in the first direction, and the first sheave rotates in the braking direction in response to movement of the force receiving member in the second direction.

N2. The exercise apparatus of claim N1, further comprising means for establishing a first threshold of user imposed force sufficient to move the force receiving member in the first direction and a discrete, second threshold of user imposed force sufficient to move the force receiving member in the second direction.

P1. An exercise apparatus, comprising:

a shell having an exterior and defining an interior compartment;

a re-directional bearing rotatably mounted on the shell in a manner that defines a passage from the exterior to the interior compartment;

a sheave rotatably mounted within the interior compartment, wherein the sheave includes first and second sidewalls that define a groove therebetween; and a cord having a first end portion connected to the sheave and disposed between the surfaces, and an opposite second end portion routed through the passage, wherein the passage is bounded by surfaces that are disposed inboard of the sidewalls for any orientation of the bearing.

Q1. An exercise apparatus, comprising:

a frame;

a sheave rotatably mounted on the frame, wherein the sheave includes first and second sidewalls that define a groove therebetween;

a force receiving member;

a cord having a first end portion connected to the sheave and disposed between the sidewalls, and an opposite second end portion connected to the force receiving member;

a re-directional bearing assembly, including a guide member rotatably mounted on the frame, wherein an intermediate portion of the cord is routed through a passage defined by the re-directional bearing assembly, and the passage is bounded by surfaces that are disposed inboard of the sidewalls regardless of how the guide member is oriented relative to the frame.

R1. An exercise apparatus, comprising:

an elongate strap having (a) a first side and an opposite second side that define a thickness therebetween; (b) a first end and an opposite, second end that define a length therebetween; and (c) a first edge and an opposite, second edge that define a width therebetween;

a patch of hook-type fasteners secured to the first side proximate the first end;

a patch of loop-type fasteners secured to the first side between the hook-type fasteners and the second end;

a strip having a first end, and second end, and an intermediate portion extending therebetween, wherein the intermediate portion is secured to the first side proximate the second end;

a ring member bearing against the second side of the strap, opposite the intermediate portion of the strip, wherein the first end of the strip is routed around a proximate portion of the ring member and then away from the second end of the strap, and is sewn to the second side of the strap, and the second end of the strip is routed around a proximate portion of the ring member and then away from the second end of the strap, and is sewn to the second side of the strap, and an intermediate portion of the ring member is exposed in a gap between the first end of the strip and the second end of the strip, and an opposite half of the ring member is exposed between the strip and the second end of the strap, whereby the strap may be arranged in a closed loop with the first end of the strap routed around the exposed half of the ring member and then back against itself with the hook-type fasteners engaging the loop-type fasteners;

a resistance device; and a cord interconnected between the resistance device and the exposed intermediate portion of the ring member.

R2. The exercise apparatus of R1, wherein the ring member is a D-ring, and each said end of the strip wraps around a respective curved portion of the D-ring, and the first end of the strap wraps around an opposing straight portion of the D-ring.

R3. The exercise apparatus of claim R1, further comprising a second resistance device; and a second cord interconnected between the second resistance device and the exposed intermediate portion of the ring member.

R4. The exercise apparatus of claim R3, further comprising a frame configured to rest on a floor surface, wherein the frame has a first end and an opposite, second end; and a body support mounted on the frame and sized and configured to support a person in a supine position above the floor surface and between the first end and the second end, wherein the second cord extends directly from the ring member to the second end of the frame, and the other cord extends directly from the ring member to the first end of the frame.

R5. The exercise apparatus of claim R4, wherein each said resistance device includes a sheave and a re-wind spring operatively connected to the sheave, and when the strap is moved toward the first end, the second cord unwinds from the second sheave, and the other cord re-winds onto the other sheave, and conversely, when the strap is moved toward the second end, the cord unwinds from the other sheave, and the second cord re-winds onto the second sheave.

S. An exercise apparatus, comprising:

a shell having an exterior and defining an interior compartment, wherein the exterior includes a front face and a back face, and a first vertical slot extends through each said face proximate a first side of the shell, and a second vertical slot extends through each said face proximate an opposite, second side of the shell;

a strap connected to the shell to receive a person's open hand between the strap and a proximate said face of the shell, wherein the strap includes a first end that is tapered, an opposite, second end that is connected to a buckle, and an intermediate portion extending therebetween, and a distal end portion of the strap, including the first end and various amounts of the intermediate portion, is inserted through the first vertical slot and then wrapped about the front face and then inserted through the second vertical slot and then inserted through the buckle to define a closed loop;

a cord routing member mounted on the shell in a manner that defines a passage from the exterior to the interior compartment;

a sheave rotatably mounted within the interior compartment; and a cord having a first end portion connected to the sheave, an intermediate portion extending through the cord routing member, and an opposite, second end portion connected to a force receiving member.

T. An exercise apparatus, comprising:

a shell having an exterior and defining an interior compartment, wherein the exterior includes a front face and a back face, and a first vertical slot extends through each said face proximate a first side of the shell, and a second vertical slot extends through each said face proximate an opposite, second side of the shell, and a first horizontal slot extends through each said face proximate a bottom side of the shell;

a shoe;

at least one strap interconnected between the shoe and the shell to mount the shell on the shoe, wherein the strap includes a first strap segment that extends through the first horizontal slot and forms a closed loop about an instep portion of the shoe and at least part of the shell, a first end that is tapered, an opposite, second end that is connected to a buckle, and an intermediate portion extending therebetween, and a distal end portion of the strap, including the first end and various amounts of the intermediate portion, is inserted through the first vertical slot and then wrapped about the front face and then inserted through the second vertical slot and then inserted through the buckle to define a closed loop;

a cord routing member mounted on the shell in a manner that defines a passage from the exterior to the interior compartment;

a sheave rotatably mounted within the interior compartment; and a cord having a first end portion connected to the sheave, an intermediate portion extending through the cord routing member, and an opposite, second end portion connected to a force receiving member.

What is claimed is:

1. An exercise apparatus, comprising:

a frame;

a shaft rotatably mounted on the frame;

a sheave mounted to the shaft for rotation in a first direction together with the shaft, and for rotation in an opposite, second direction relative to the shaft;

a spiral rewind spring having a first end and an opposite, second end, wherein the first end is fastened to the sheave for rotation together with the sheave;

a connector rotatably mounted on the shaft, wherein the connector is operatively interconnected in series between the frame and the second end of the rewind spring; and a cord operatively interconnected in series between the sheave and a force receiving member, wherein the sheave rotates with the shaft in the first direction in response to a user exerting force against the force receiving member, and the sheave rotates relative to the shaft in the second direction in response to the rewind spring exerting force against the sheave.

2. The exercise apparatus of claim 1, wherein the connector is nested inside coils of the rewind spring.

3. The exercise apparatus of claim 2, wherein the connector defines a round perimeter, and the rewind spring coils about the round perimeter.

4. The exercise apparatus of claim 3, wherein the second end of the spring is disposed inside the perimeter.

5. The exercise apparatus of claim 4, wherein the perimeter is a cylinder centered about an axis disposed a distance apart from an axis of rotation defined by the shaft.

6. The exercise apparatus of claim 2, further comprising a housing disposed about the rewind spring, wherein a first portion of the connector is disposed inside the housing, and a second portion of the connector is disposed outside the housing.

7. The exercise apparatus of claim 6, wherein the connector is sized and configured to key into multiple different orientations relative to the housing.

8. The exercise apparatus of claim 6, wherein the connector defines a round perimeter, and the rewind spring coils about the round perimeter, and the second end of the spring is disposed inside the perimeter.

9. The exercise apparatus of claim 1, wherein the connector is selectively rotatable relative to the frame to adjust how much rewind force is exerted by the spring.

10. The exercise apparatus of claim 1, wherein the connector defines a round perimeter, and the rewind spring coils about the round perimeter, and the second end of the spring is disposed inside the perimeter.

11. An exercise apparatus, comprising:

a frame;

a shaft rotatably mounted on the frame;

a first rotating member operatively connected to the shaft for rotation with the shaft in a first direction and relative to the shaft in an opposite, second direction;

a second rotating member rigidly connected to the shaft for rotation with the shaft in each said direction, wherein one said rotating member is a brake device, and the other said rotating member is a sheave;

a coiled rewind spring having an inner end and an opposite, outer end, wherein the outer end is fastened to the sheave for rotation together with the sheave;

a spring bushing mounted on the shaft, wherein at least part of the spring bushing is nested inside the rewind spring, and the spring bushing is interconnected in series between the frame and the inner end of the rewind spring, and the spring bushing defines a round perimeter, and the inner end of the rewind spring is disposed inside the perimeter;

a cord operatively interconnected in series between the sheave and a force receiving member, wherein the sheave rotates with the brake device in the first direction in response to a user exerting force against the force receiving member, and the sheave rotates relative to the brake device in the second direction in response to the rewind spring exerting force against the sheave.

12. The exercise apparatus of claim 11, wherein the perimeter is a cylinder centered about an axis disposed a distance apart from an axis of rotation defined by the shaft.

13. The exercise apparatus of claim 11, further comprising a housing disposed about the rewind spring, wherein a first portion of the connector is disposed inside the housing, and a second portion of the connector is disposed outside the housing.

14. The exercise apparatus of claim 13, wherein the connector is sized and configured to key into multiple different orientations relative to the housing.

15. The exercise apparatus of claim 11, wherein the connector is selectively rotatable relative to the frame to adjust how much rewind force is exerted by the spring.

16. An exercise apparatus, comprising:

a frame;

a drum rotatably mounted on the frame for rotation about an axis;

a brake member operatively connected to the drum to resist rotation of the drum;

a sheave rotatably mounted on the frame, wherein the sheave is operatively connected to the drum to rotate in a first direction together with the drum, and to rotate in an opposite, second direction relative to the drum;

a force receiving member;

a cord operatively interconnected between the sheave and the force receiving member to be extracted from the sheave when user force applied against the force receiving member overcomes resistance to rotation of the drum in the first direction;

a spring bushing connected to the frame; and a rewind spring interconnected between the sheave and the spring bushing to bias the sheave to rotate in the second direction and rewind extracted cord onto the sheave when rewind force applied by the rewind spring is greater than user applied force against the force receiving member, wherein the rewind spring is coiled about the spring bushing.

17. The exercise apparatus of claim 16, wherein the spring bushing defines a cylindrical outer surface that bears against an innermost coil of the rewind spring.

18. The exercise apparatus of claim 16, wherein the spring bushing defines a notch, and an inner end of the rewind spring is secured inside the notch.

19. The exercise apparatus of claim 16, wherein the sheave is rotatably mounted on a shaft having a shaft diameter, and the spring bushing defines an outer diameter that is greater than the shaft diameter.

20. The exercise apparatus of claim 16, wherein the spring bushing is configured to occupy any one of several predetermined orientations relative to the frame.

* * * * *